US007290952B2

(12) United States Patent
Kagami

(10) Patent No.: US 7,290,952 B2
(45) Date of Patent: Nov. 6, 2007

(54) RECORDING APPARATUS WITH A SLIDABLY ACCOMMODATED DISCHARGE TRAY

(75) Inventor: Yuji Kagami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 10/902,058

(22) Filed: Jul. 30, 2004

(65) Prior Publication Data

US 2005/0052518 A1 Mar. 10, 2005

(30) Foreign Application Priority Data

Aug. 1, 2003 (JP) ..... 2003-205479

(51) Int. Cl.
*B41J 29/02* (2006.01)

(52) U.S. Cl. ..... 400/693; 400/691; 347/108; 347/170; 347/152; 399/405; 271/144; 271/206

(58) Field of Classification Search ..... 400/693, 400/691; 347/108, 170, 152, 222, 263; 399/405; 271/209, 288, 144, 206, 172
See application file for complete search history.

(56) References Cited

U.S. PATENT DOCUMENTS 5,111,252 A * 5/1992 Hamada et al. ..... 399/393
6,106,178 A * 8/2000 Chiu ..... 400/624
6,231,043 B1 * 5/2001 James et al. ..... 271/209
6,676,318 B2 * 1/2004 Hwang et al. ..... 400/693
6,830,401 B1 * 12/2004 Hwang et al. ..... 400/693
6,899,474 B2 * 5/2005 Uchida et al. ..... 400/27
6,991,331 B2 * 1/2006 Kagami et al. ..... 347/108
7,070,350 B2 * 7/2006 Inokuchi et al. ..... 400/680
2004/0013459 A1 * 1/2004 Chen ..... 400/691
2004/0207144 A1 * 10/2004 Kanome et al. ..... 271/9.01

FOREIGN PATENT DOCUMENTS

JP 2003-54070 2/2003

* cited by examiner

*Primary Examiner*—Ren Yan
*Assistant Examiner*—Matthew Marini
(74) *Attorney, Agent, or Firm*—Fitzpatrick, Cella, Harper & Scinto

(57) ABSTRACT

The invention provides the recording apparatus, which has excellent operability of drawing and retracting the sheet discharge tray and excellent design in accommodating the sheet discharge tray and includes a sheet discharge mechanism having an advantage for miniaturization and improvement of performance of the recording apparatus. A tray accommodation portion which slidably accommodates a sheet discharge unit including a plurality of sheet discharge trays and an opening portion which is opened and closed by a cover member are provided in an exterior of the apparatus. The drawn sheet discharge tray is retained on a backside of the cover member retained at a predetermined opening angle. Stepwise grooves having difference of elevation for sliding guide protrusions provided in the sheet discharge tray unit are formed on both sides of the tray accommodation unit.

11 Claims, 14 Drawing Sheets

RECORDING APPARATUS WITH A SLIDABLY ACCOMMODATED DISCHARGE TRAY

BACKGROUND OF THE INVENTION

1. Field of the Invention

The present invention relates to a recording apparatus which performs recording into a recording medium on the basis of recording information.

2. Related Background Art

A sheet discharge mechanism is provided in the recording apparatus such as a printer, a copying machine, a word processor, a personal computer, and a facsimile machine. The sheet discharge mechanism discharges the recording medium (hereinafter, it may be referred to as recording sheet) such as a recording paper in which the recording has been performed on the basis of the recording information (image information or the like) to the outside of the apparatus. Normally a discharge tray (sheet discharge tray unit) for retaining the discharged recording sheet is provided in the sheet discharge mechanism.

FIG. 23 is a schematic perspective view illustrating the state in which the sheet discharge tray is drawn in the conventional recording apparatus, FIG. 24 is a schematic side elevation for explaining a technical problem of the sheet discharge tray in the conventional recording apparatus, FIG. 25 is the schematic perspective view showing the state in which the front cover is closed in the conventional recording apparatus, and FIG. 26 is a schematic longitudinal sectional view mainly showing a structure of the tray accommodation unit of the lower case in the conventional recording apparatus.

In FIGS. 23 to 26, the recording apparatus includes a lower case 18, an upper case 19, an access cover 27, a sheet discharge unit, and a printer unit (not shown) which is accommodated inside an exterior case of the apparatus. As shown in FIG. 23, the sheet discharge unit includes three components of a first sheet discharge tray 20, a second sheet discharge tray 21, and a third sheet discharge tray 22. Each of grooves or ribs is formed on both sides of the sheet discharge trays 20, 21, and 22, and the sheet discharge trays 20, 21, and 22 engage one another. Therefore, the sheet discharge trays 20, 21, and 22 are mounted on a main body of the apparatus while being slidable along one another. The sheet discharge trays 20, 21, and 22 can be drawn from the main body of the apparatus. The sheet discharge trays 20, 21, and 22 are accommodated in the tray accommodation unit of a bottom portion of the lower case 18 in non-use.

Pawls (not shown) formed in left and right points in a rear portion of surface of the first sheet discharge tray 20 are configured so as to be able to fit to the pawls formed in the left and right points in front and rear portions of tray accommodation unit of the lower case 18. Ribs having concave and convex portions are formed in the front portion of a backside of the first sheet discharge tray 20, and the ribs can fit to concave portions formed in the left and right points in the front and rear portions of the backside of the second sheet discharge tray 21. The pawls (not shown) are formed on the left and right sides in the front and rear portions of the backside of the second sheet discharge tray 21, the pawls (not shown) are also formed inside grooves 22*a* and 22*b* formed on the left and right sides the surface of the third sheet discharge tray 22, and the pawls fit to one another.

In the above configuration, at first a front cover 27 is rotated to expose a sheet discharge outlet (opening portion) in a front face of the recording apparatus in performing the recording (printing). At this point, the front cover 27 is retained in a predetermined angle by tray rails fixed to the lower case 18 while maintaining an appropriate gap from a floor surface (loading surface) on which the recording apparatus is installed. When an operator places operator's finger on a handgrip portion 22*c* formed in the front portion of the third sheet discharge tray 22 to pull the third sheet discharge tray 22, the second sheet discharge tray 21 and the first sheet discharge tray 20 are sequentially drawn from a main body of the apparatus to a predetermined length by the pawls, and then the second sheet discharge tray 21 and the first sheet discharge tray 20 are retained and fixed in the state shown in FIG. 23. A height of a front end of the third sheet discharge tray 22 is maintained at a height position substantially equal to a sheet discharge path in such a manner that a bottom surface of the first sheet discharge tray 20 abuts on height adjustment ribs (not shown) of the front cover 27. Thus, the recording sheet which is of the recording medium discharged from the recording apparatus is sequentially stacked on the sheet discharge tray unit.

When the recording (printing) is finished, the third sheet discharge tray 22 is moved backward to release the fitting between the pawls, the second sheet discharge tray 21 and the first sheet discharge tray 20 are sequentially retracted, and the sheet discharge tray unit including three sheet discharge trays is accommodated in the tray accommodation unit of the lower case 18. In an inkjet recording apparatus in which the recording is performed by ejecting ink from recording means to the recording medium, when discharge speed of the recording sheet discharged from the recording apparatus is increased in order to increase recording processing speed, because the next recording sheet is stacked before the ink of the previously recorded recording medium (recording sheet) is not dried, sometimes there is generated a problem that the previously discharge recording sheet is soiled by the ink of the subsequently discharged recording sheet or the recording ink (adhesion ink) is rubbed.

In order to solve the problem, it has been proposed that the discharged recording sheet is retained (the recording sheet is bent) while curvature is given by forming a shape of the front end of the third sheet discharge tray 22 in an arcuate shape, thereby the ink soil of the previously discharged recording sheet is prevented. The discharge can be also performed to the recording sheet having higher rigidity in such a manner that the front end height of the third sheet discharge tray 22 substantially corresponds to the sheet discharge path of the recording apparatus, and the front end portion of the recording sheet can be preventing from catching in discharging the recording sheet. Therefore, in order to secure sheet discharge function (sheet discharge performance), it is necessary to precisely keep the curvature of the front end shape of the third sheet discharge tray 22 and the retaining attitude (height) in drawing the sheet discharge tray within predetermined values. Japanese Patent Application Laid-Open No. 2003-054070 can be cited as an example of a patent reference disclosing the above-described conventional technology or similar technology.

In the conventional recording apparatus, when the recording apparatus is not used, the recording apparatus adopts means for accommodating the sheet discharge tray unit in the bottom portion of the main body. However, since the front end portion of the third sheet discharge tray 22 has the curvature, there is a limitation in the vertical direction, and there is the technical problem that the sheet discharge tray unit can not be completely accommodated in the tray accommodation unit of the lower case 18. Further, as shown in FIG. 26, in order to decrease the height of the main body of the recording apparatus, there is the technical problem that the sheet discharge tray unit is accommodated while the front end portion of the third sheet discharge tray 22 is protruded from the tray accommodation unit. Namely, in order to clearly express a front face of the recording apparatus from the viewpoint of appearance of the recording apparatus, it is necessary to adopt a technique of extending the front portion of the main body of the recording apparatus by the amount of protrusion of the front end portion of the third sheet discharge tray 22. Therefore, when the appearance is improved, there is the problem that an overall configuration of the recording apparatus is enlarged.

On the other hand, when the third sheet discharge tray 22 is fully accommodated in the tray accommodation unit in order to reduce a size in a depth direction of the main body of the recording apparatus, since it is necessary to increase the height of the main body of the recording apparatus by the height in which the front end portion of the third sheet discharge tray 22 has the curvature, there is also the problem that an overall configuration of the recording apparatus is enlarged. The retaining attitude (height) of the sheet discharge tray can be controlled in such a manner that a part of the first sheet discharge tray 20 abuts on the height adjustment rib of the front cover.

In the case where the front portion of the main body of the recording apparatus (exterior of the apparatus) has a rounded appearance, generally an outline of the front cover also has the rounded shape. As can be seen from FIG. 24, in the case where the. curvature of the front cover 27 is increased (radius of curvature is decreased), a height H1 from the floor surface to the front end portion of the front cover 27 is increased in opening the front cover 27 when compared the substantially plane-shaped front cover. The bottom surface of the first sheet discharge tray 20 abuts on the front portion of the front cover 27. As a result, the front end of the third sheet discharge tray 22 is separated upward away from the sheet discharge path by a distance H2 (the height is increased by H2), and the problem occurs when the recording sheet having higher rigidity is discharged.

SUMMARY OF THE INVENTION

In view of the foregoing, it is an object of the invention to provide the recording apparatus, which has excellent operability of drawing and retracting the sheet discharge tray and excellent design in accommodating the sheet discharge tray and includes a sheet discharge mechanism having an advantage for miniaturization and improvement of performance of the recording apparatus.

In order to achieve the above object, an recording apparatus of the invention comprises an exterior of the apparatus having an opening portion for discharging a recording medium in which recording has been performed, a sheet discharge tray unit having a plurality of sheet discharge trays for stacking and retaining the recording medium discharged from the opening portion, a cover member which is rotatably attached to the exterior of the apparatus in order to open and close the opening portion, a tray accommodation unit which is provided in a bottom portion of the exterior of the apparatus in order to drawably accommodate the sheet discharge tray unit, and guiding means for retaining the cover member in predetermined position while guiding the sheet discharge trays in the drawing direction and in the accommodating direction, wherein the sheet discharge tray drawn from the tray accommodation unit is retained at a predetermined opening position on a backside of the cover member, and stepwise grooves having difference of elevation for sliding guide protrusions provided in the sheet discharge tray unit are formed on both sides of the tray accommodation unit.

DETAILED DESCRIPTION OF THE PREFERRED EMBODIMENT

Figure 1:
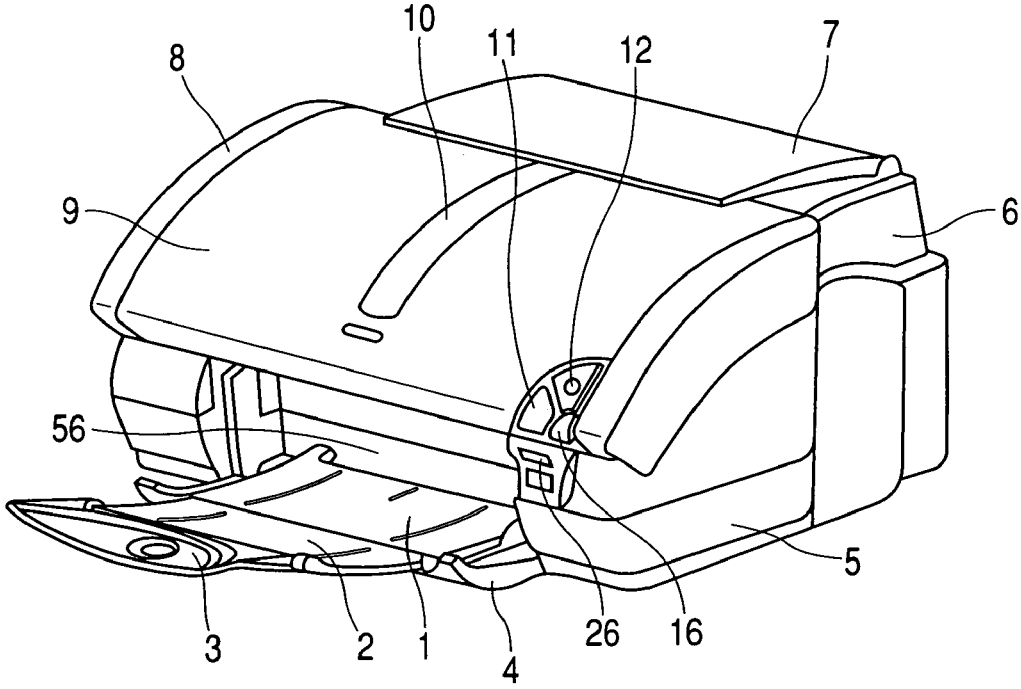
FIG. 1 is a schematic perspective view showing a state in which a sheet discharge tray is drawn in a recording apparatus according to a first embodiment of the invention.
Figure 2:
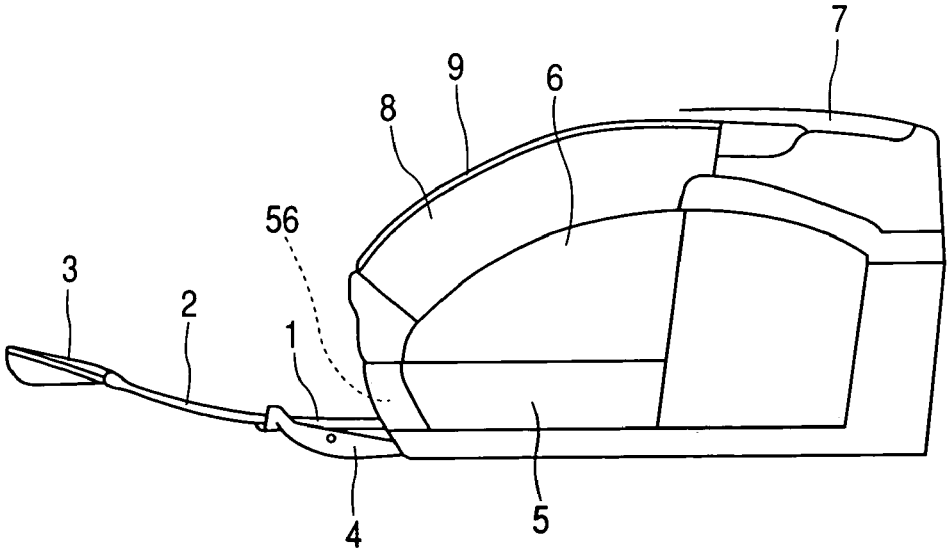
FIG. 2 is a schematic side elevation view showing the state in which the sheet disparage tray is drawn in the recording apparatus of FIG. 1.
Figure 3:
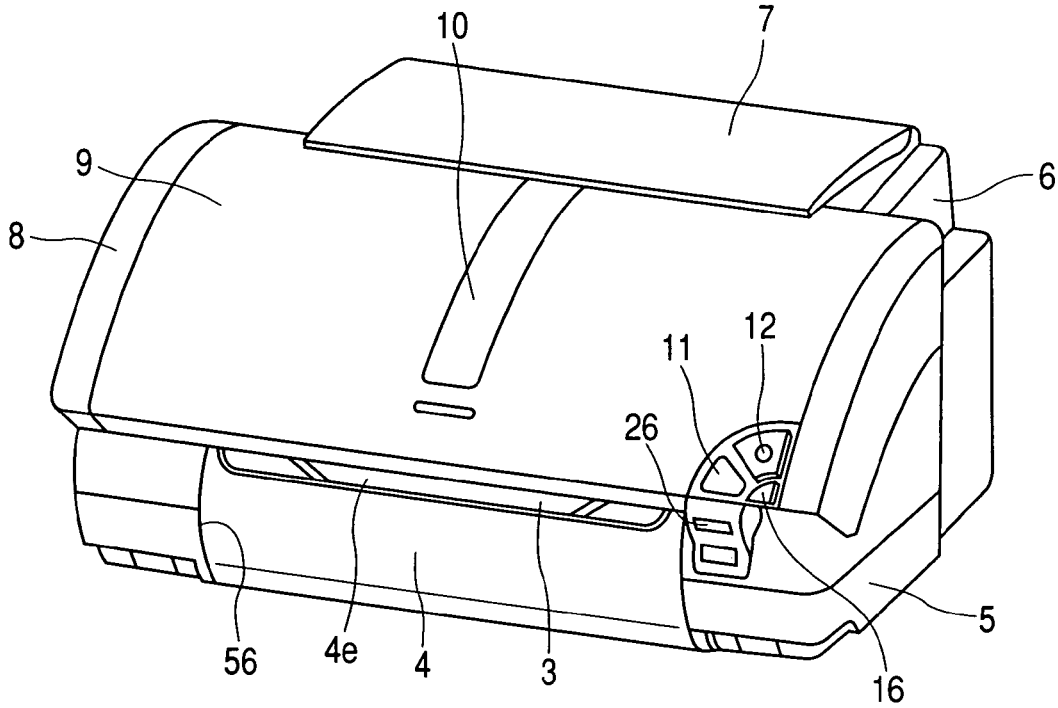
FIG. 3 is a schematic perspective view showing the state in which a cover member (front cover) is closed to accommodate the sheet discharge tray in the recording apparatus according to the first embodiment of the invention.
Figure 4:
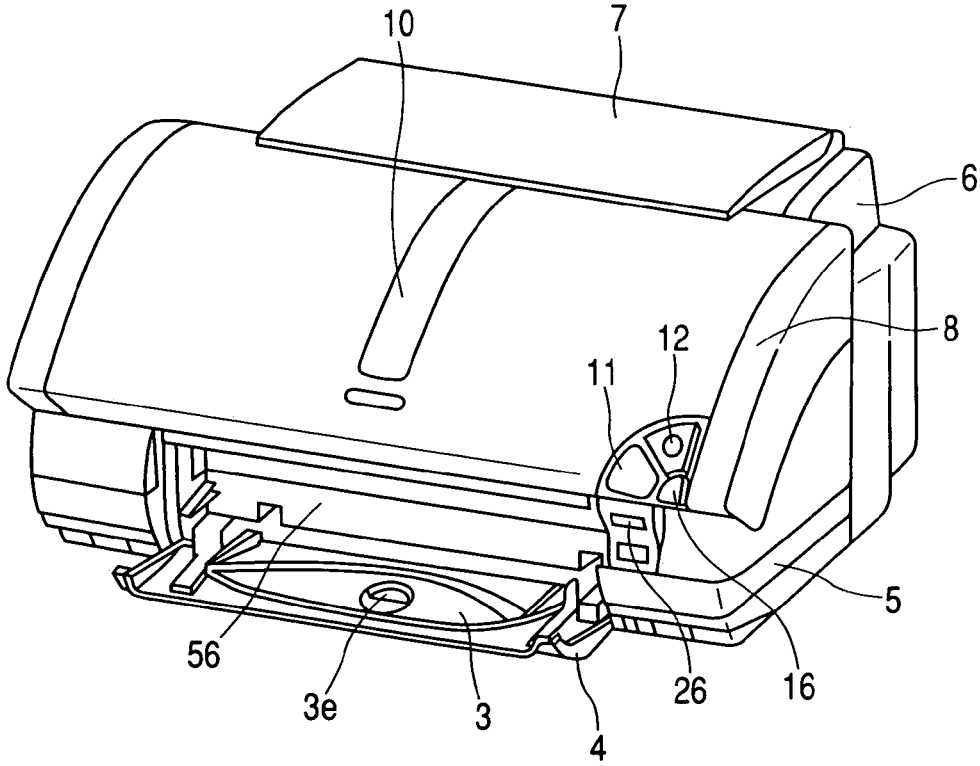
FIG. 4 is a schematic perspective view showing the state in which the cover member is opened in the recording apparatus of FIG. 3.

Referring to the accompanying drawings, preferred embodiments of the invention will be specifically described below. In the following drawings, the same reference numeral indicates the same region or the corresponding region. FIG. 1 is the schematic perspective view showing the state in which the sheet discharge tray is drawn in the recording apparatus according to a first embodiment of the invention, FIG. 2 is the schematic side elevation view showing the state in which the sheet disparage tray is drawn in the recording apparatus of FIG. 1, FIG. 3 is the schematic perspective view showing the state in which a cover member (front cover) is closed to accommodate the sheet discharge tray in the recording apparatus according to the first embodiment of the invention, and FIG. 4 is the schematic perspective view showing the state in which the cover member is opened in the recording apparatus of FIG. 3.

In FIGS. 1 to 4, the reference numeral 1 designates a first sheet discharge tray (first member), the reference numeral 2 designates a second sheet discharge tray (second member), the reference numeral 3 designates a third sheet discharge tray (third member), the reference numeral 4 designates a front cover as the cover member, the reference numeral 5 designates a lower case, the reference numeral 6 designates an upper case, the reference numeral 7 designates a sheet feed cover, the reference numeral 8 designates an access cover, the reference numeral 9 designates a decorated cover, the reference numeral 10 designates an access window, the reference numeral 11 designates a power key (power switch button), the reference numeral 12 designates a reset key (reset button), the reference numeral 16 designates LED (light-emission element), the reference numeral 26 designates a camera direct connector, and the reference numeral 56 designates a opening portion of the exterior of the apparatus which is opened and closed by the cover member 4. The recording apparatus of the embodiment includes the lower and upper cases 5 and 6 which form the exterior of the apparatus, an access cover unit which is formed by incorporating the decorated cover 9 and the access window 10 into the access cover 8, the front cover 4 which is of the cover member rotatably retained by and fixed to the lower case 5, the sheet feed cover 7 which covers an automatic sheet feeder (not shown), and a printer unit which is accommodated within the exterior of the apparatus formed by these exterior members.

The access window is formed by a transparent material. The access window 10 emits light during the recording in such a manner that the light of the light-emission source such as an LED is attached to a carriage (not shown) reciprocally moving while mounting the recording head as the recording means. This allows an operator to be informed of the normal operation of the carriage. The recording apparatus of the embodiment has a sheet discharge unit 55 (FIG. 15) including the first sheet discharge tray 1, the second sheet discharge tray 2, and the third sheet discharge tray 3. The sheet discharge tray unit 55 is drawably accommodated in a tray accommodation unit 5*a* (FIG. 6) provided in the bottom portion of the lower case 5.

The lower case 5 forms a lower substantially half portion of the exterior of the apparatus and the upper cases 6 forms an upper substantially half portion of the exterior of the apparatus. A hollow structure having an accommodation space for accommodating the printer unit is formed by combining the cases 5 and 6 each other. The opening portion 56 which is opened and closed by the cover member (front cover) 4 is formed at a front portion of the hollow structure, and the opening portion is also formed at an upper portion of the hollow structure. Although an inner structure (recording mechanism unit) of the recording apparatus is not shown in detail, the recording apparatus is configured so that the sheet feed cover 7 is opened to draw a sheet feed tray (not shown) formed by a plurality of auxiliary trays attached to the inside of the sheet feed tray, the recording sheet which is of the recording medium set on the sheet feed tray is separately supplied one by one to perform the recording to the recording sheet by the recording means, and the recording sheet in which the recording has been performed is discharged onto the sheet discharge tray unit 55.

Then, the configuration of the recording means will be briefly described. The recording apparatus of the embodiment is an inkjet recording apparatus in which the recording is performed by ejecting ink from the recording means to the recording medium. A recording head 31 includes a row of nozzles formed by arraying the plurality of micro nozzles, a liquid channel leading to each nozzle, a common liquid chamber commonly leading to each liquid channel, and ink ejection energy generating means arranged in each liquid channel. The means in which an electromechanical transducer such as a piezoelectric element is utilized, the means in which an ink droplet is ejected by action of heat generation caused by the irradiation of an electromagnetic wave such as a laser beam, or the means in which an electrothermal transducer such as an electrical heating is utilized is used as the ink ejection energy generating means. Particularly, the recording means in which the ink droplet is ejected by the heat energy can perform the recording in high resolution, because the nozzles for forming the ink droplet can be arranged with high density.

The recording apparatus including the recording head utilizing the electrothermal transducer has advantages that miniaturization is easy to perform, high-density mounting is easy to perform, and the production is performed at low cost. In the case of the recording means in which the electrothermal transducer is utilized, the recording means is operated such that a pulse voltage is applied to electrothermal transducer in accordance with a recording signal, film boiling is generated in the ink of the channel by the heat energy, and the recording is performed by utilizing the film boiling to eject the ink from the nozzle by growth and shrinkage of a bubble generated in the ink.

Figure 5:
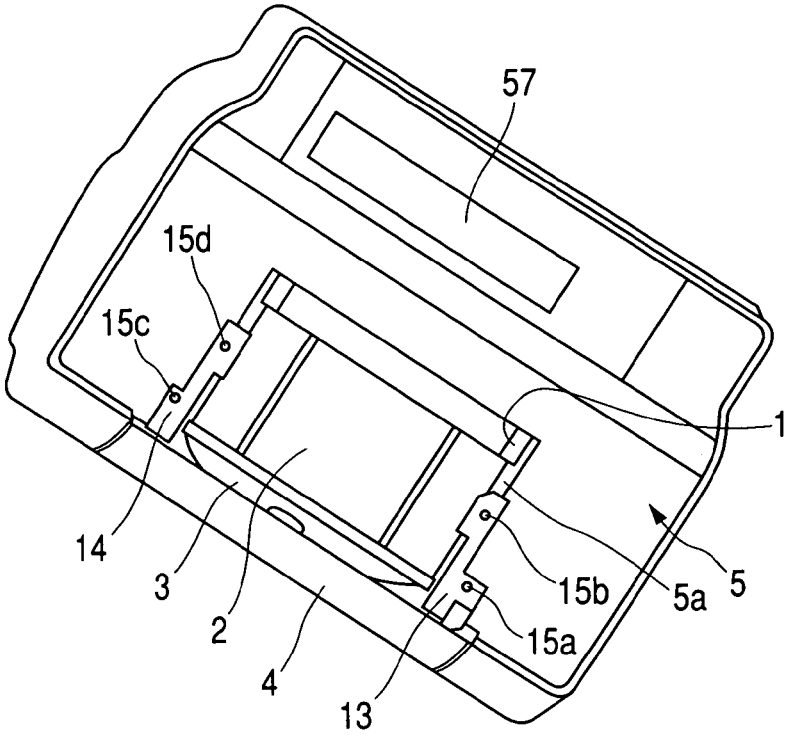
FIG. 5 is a schematic perspective view showing the recording apparatus according to the first embodiment of the invention (in the state of FIG. 3) when viewed from a bottom surface side.
Figure 6:
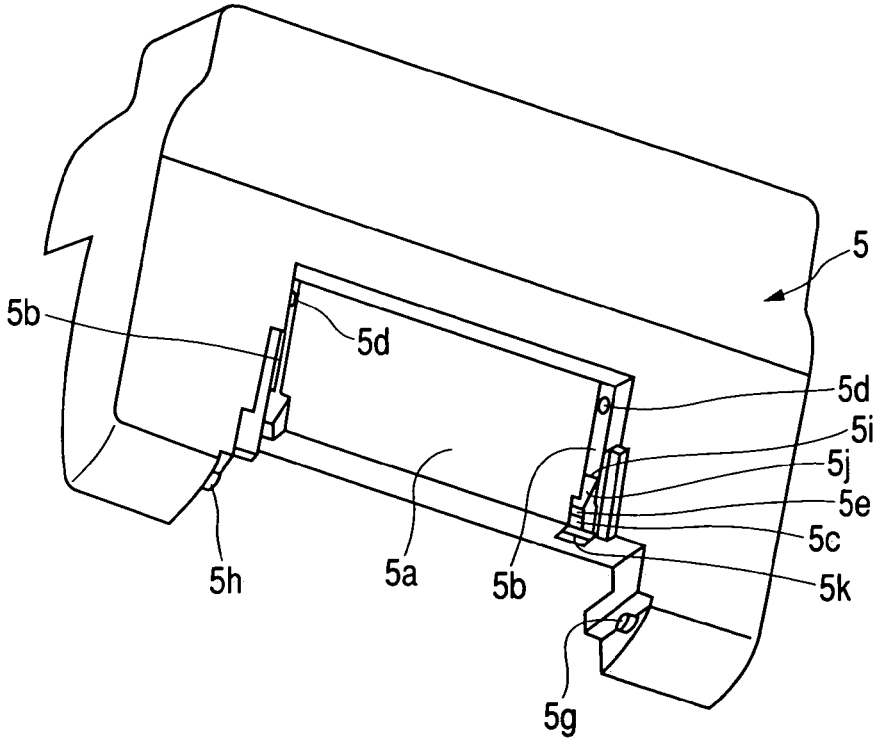
FIG. 6 is a schematic perspective view showing a lower case of the recording apparatus of FIG. 5 when viewed from the bottom surface side.
Figure 7:
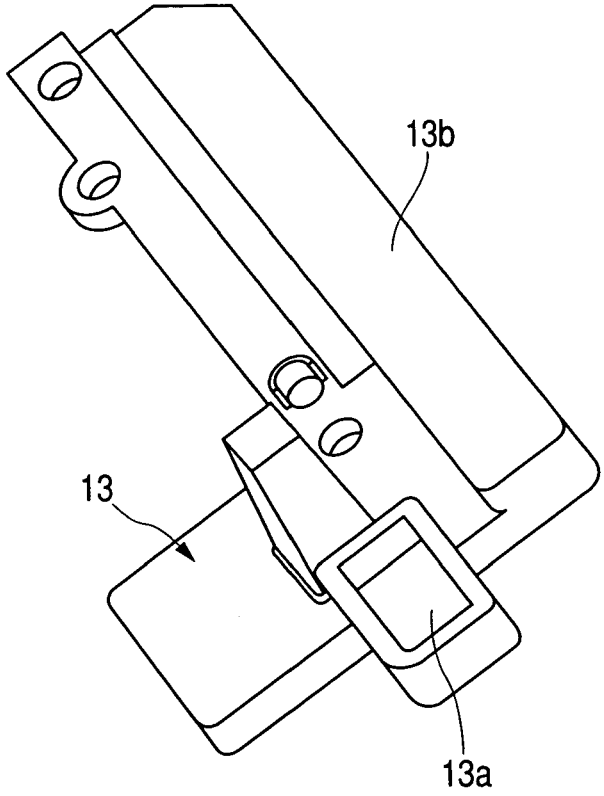
FIG. 7 is a schematic perspective view showing a left tray rail attached to a tray accommodation unit of the recording apparatus according to the first embodiment of the invention when viewed from a top side.
Figure 8:
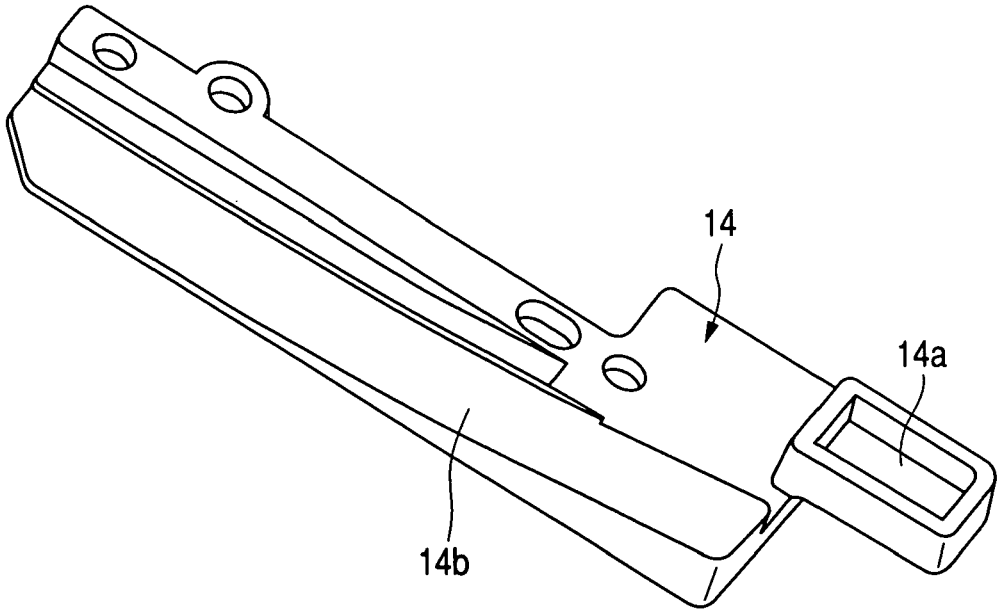
FIG. 8 is a schematic perspective view showing a right tray rail attached to the tray accommodation unit of the recording apparatus according to the first embodiment of the invention when viewed from the top side.
Figure 9:
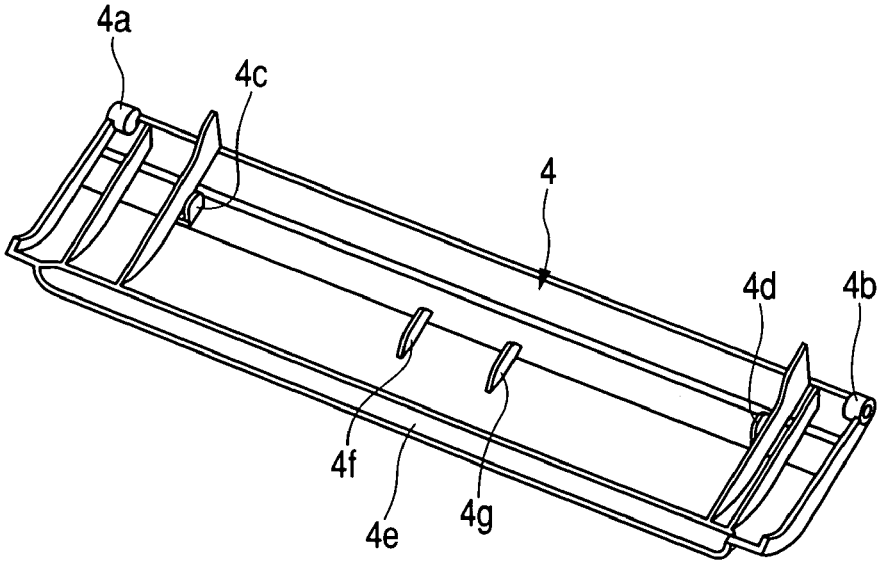
FIG. 9 is a schematic perspective view showing the cover member (front cover) of the recording apparatus according to the first embodiment of the invention when viewed from a backside.

FIG. 5 is the schematic perspective view showing the recording apparatus according to the first embodiment of the invention (in the state of FIG. 3) when viewed from a bottom surface side, FIG. 6 is the schematic perspective view showing the lower case of the recording apparatus of FIG. 5 when viewed from the bottom surface side, FIG. 7 is the schematic perspective view showing a left tray rail attached to the tray accommodation unit of the recording apparatus according to the first embodiment of the invention when viewed from a top side, FIG. 8 is the schematic perspective view showing a right tray rail attached to the tray accommodation unit of the recording apparatus according to the first embodiment of the invention when viewed from the top side, FIG. 9 is the schematic perspective view showing the cover member (front cover) of the recording apparatus according to the first embodiment of the invention when viewed from a backside.

In FIGS. 5 to 9, the tray accommodation unit 5*a* in which the later-mentioned sheet discharge tray unit 55 is accommodated is formed at the bottom portion of the lower case 5, a left tray rail 13 which is of guiding means is fixed to a predetermined position on the left side of the tray accommodation unit 5*a*, and a right tray rail 14 which is of the guiding means is fixed to a predetermined position on the right side of the tray accommodation unit 5*a*. The tray rails 13 and 14 are adapted to be fixed to the predetermined positions of the lower case 5 with screws 15*a* to 15*d*. Convex portions (protrusions) 5*d* engaging the later-mentioned concave portions 1*i* and 1*j* (FIG. 11) of the sheet discharge tray unit 55 are formed on the left and right sides of the tray accommodation unit 5*a*.

In assembling the sheet discharge mechanism device, since the left tray rail 13 and the right tray rail 14 are screwed with the screws 15 on the left and right sides of the lower case 5 (tray accommodation unit 5*a*) after the sheet discharge tray unit 55 is accommodated in the tray accommodation unit 5*a*, the sheet discharge tray unit 55 never drops off from the lower case 5 (tray accommodation unit 5*a*). On the other hand, rotating shafts 5*g* and 5*h* are formed on the left and right sides in the front portion of the lower case 5, and bearings 4*a* and 4*b* (FIG. 9) of the front cover 4 are inserted into the rotating shafts 5*g* and 5*h*. This allows the front cover 4 to be rotatably attached to the lower case 5. Open angle controlling means for controlling an open angle in opening the front cover 4 is also provided. In the sheet discharge tray unit 55, the bottom surface is slidably guided and supported by slide portions 13*b* and 14*b* of the left and right tray rails 13 and 14.

Since the sheet discharge tray unit 55 is slidably supported by the left and right tray rails 13 and 14, when the front cover 4 is rotated to the front portion to open the opening portion 56 in performing the recording operation, the sheet discharge tray unit 55 is drawn from the tray accommodation unit 5*a*, retaining each of the sheet discharge trays 1, 2, and 3 at a predetermined angle by the later-mentioned sheet discharge retaining means. Therefore, the recording sheet is enabled to be discharged and the discharged sheet is sequentially stacked on the drawn sheet discharge tray. In the sheet discharge tray unit 55, a support area of the recording sheet can be increased or decreased in three stages by pulling each sheet discharge trays 1, 2, and 3 or properly combining the rotating operation of the third sheet discharge tray 3. A front end portion (end portion) of the third sheet discharge tray 3 is formed in an arcuate shape in order to maintain sheet discharge performance of the recording sheet. Therefore, a recording medium loading surface of the front end portion of the third sheet discharge tray 3 is formed in the concave surface while the central portion of the third sheet discharge tray 3 is recessed and left and right ends of the front end portion are located higher than any other portion.

In FIGS. 1 to 4, in the access cover 8, one end portion is configured to be rotatably retained by the lower case 6 to open and close the opening portion formed on the upper surface of the main body of the apparatus. Exchange of recording heads (including head cartridges), ink tanks (not shown), and the like which are accommodated inside the main body or jam processing of the recording sheet can be performed by opening the access cover unit in which the access cover 8, the decorated cover 9, and the access window 10 are integrated. The decorated cover 9 is made of an aluminum thin plate, fitting legs (not shown) are formed in a periphery of the decorated cover 9, and the decorated cover 9 is fixed to the access cover 8 by inserting the fitting legs into position of the access cover 8 to fold the fitting legs.

Further, the access window 10 is fixed from above the decorated cover 9 in such a manner that a pawl (not shown) formed in the bottom portion of the access window 10 is inserted into a hole formed in position of the access cover 8 to hook the pawl over the backside of the access cover 8. The access cover unit is formed in the above-described manner. The protrusion formed on the backside of the access cover unit rotates a cover opening and closing lever (not shown) when the access cover unit is opened and closed. An opening and closing state of the access cover unit can be detected in such a manner that the cover opening and closing lever presses a micro switch.

In FIGS. 1 to 4, the sheet feed tray (not shown) including two auxiliary trays is drawably mounted on the backside of the sheet feed cover 7. The operator rotates the sheet feed cover 7 to draw each auxiliary tray from the sheet feed cover 7 in performing the recording (printing). This enables the recording sheet to be retained in position of the automatic sheet feeder (not shown). The power key 11 and the reset key 12 are provided in the front surface of the main body of the upper case 6 while the power key 11 and the reset key 12 can be held down. When the power key 12 is held down, LED 16 provided in the front surface of the main body of the upper surface is turned on to inform the operator of recording availability.

More particularly, various display functions can be performed such that the operator is informed of the operating condition of the recording apparatus or the trouble by changing a lighting way or color of LED 16 or sounding a buzzer. In the case where the trouble is solved, the recording is resumed by holding down the reset key 12. The camera direct connector 26 is provided below the power key 11. A photograph recorded in the digital camera can be directly printed with the recording apparatus without starting up the personal computer or the like by connecting a digital camera to the connector 26 with a cable.

Figure 10:
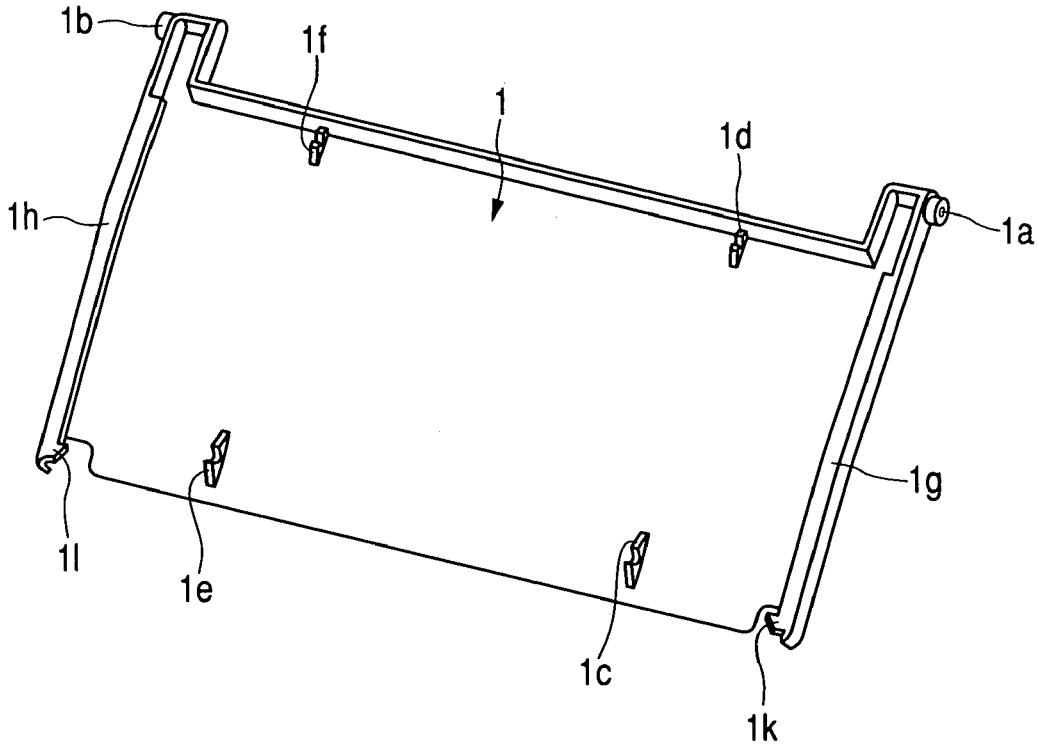
FIG. 10 is a schematic perspective view showing a first sheet discharge tray of the recording apparatus according to the first embodiment of the invention when viewed from the backside.
Figure 11:
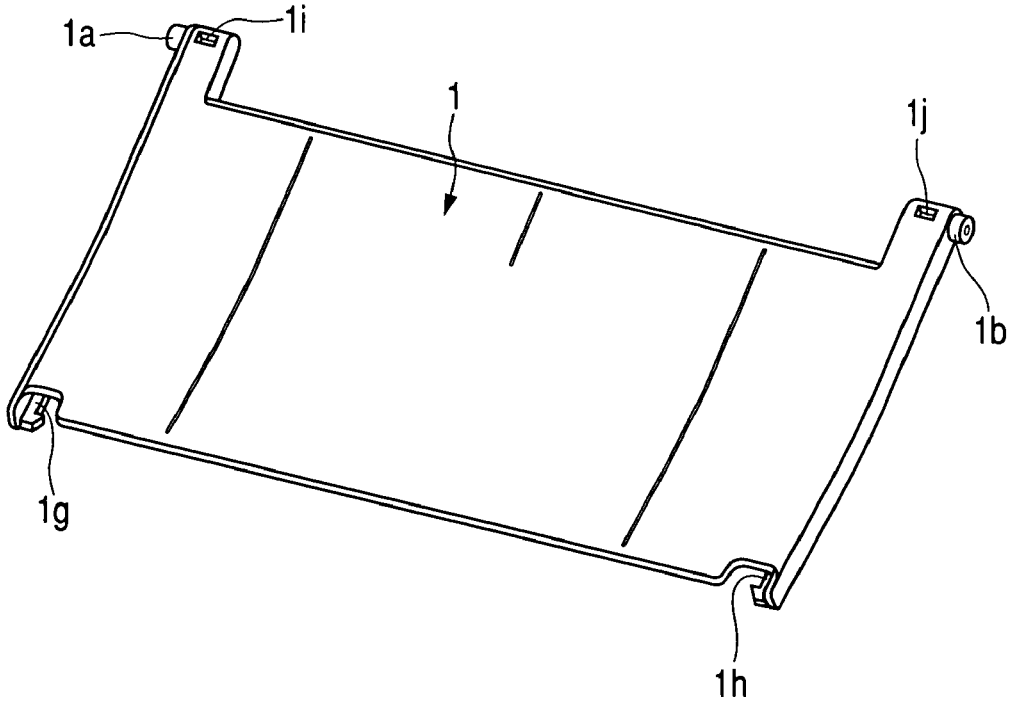
FIG. 11 is a schematic perspective view showing the first sheet discharge tray of FIG. 10 when viewed from a surface side.
Figure 12:
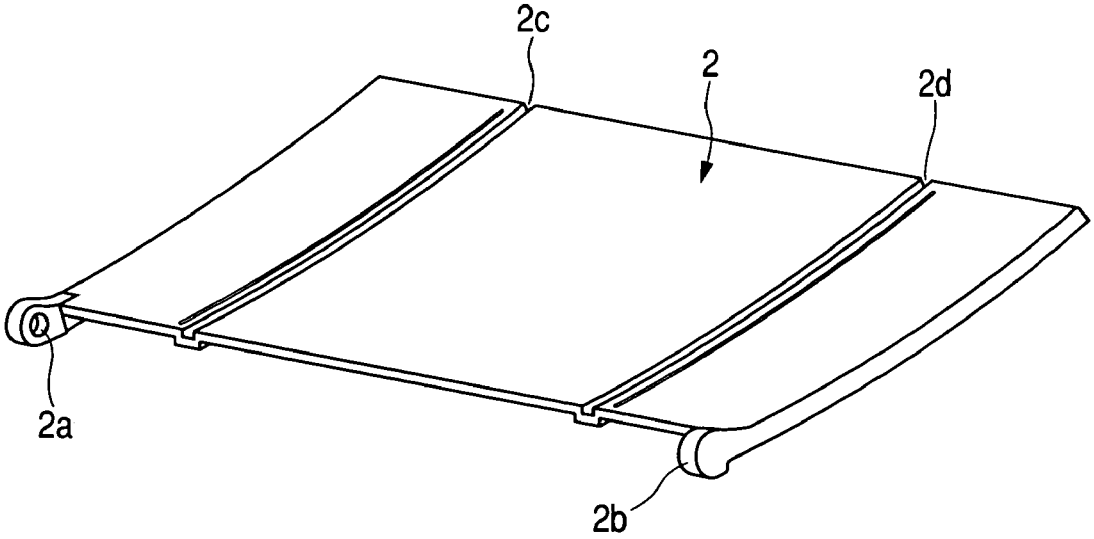
FIG. 12 is a schematic perspective view showing a second sheet discharge tray of the recording apparatus according to the first embodiment of the invention when viewed from the surface side.
Figure 13:
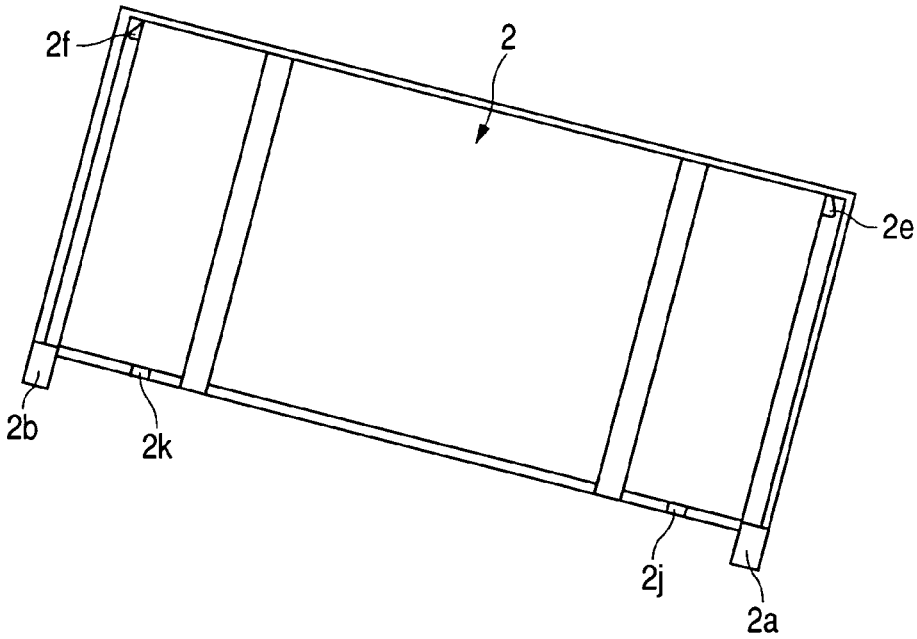
FIG. 13 is a schematic perspective view showing the second sheet discharge tray of FIG. 12 when viewed from a surface side.
Figure 14:
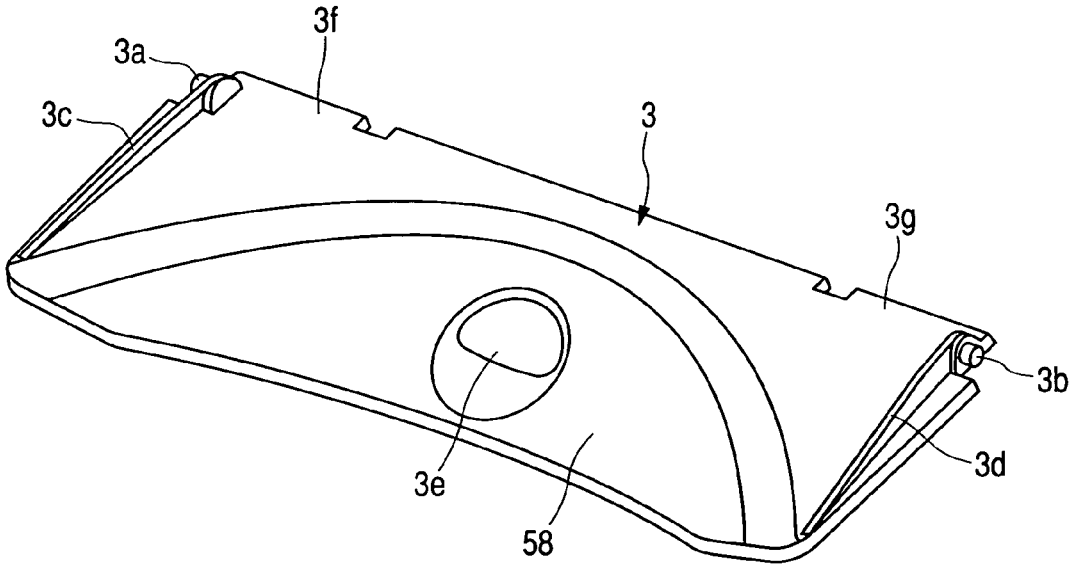
FIG. 14 is a schematic perspective view showing a third sheet discharge tray of the recording apparatus according to the first embodiment of the invention when viewed from the surface side.
Figure 15:
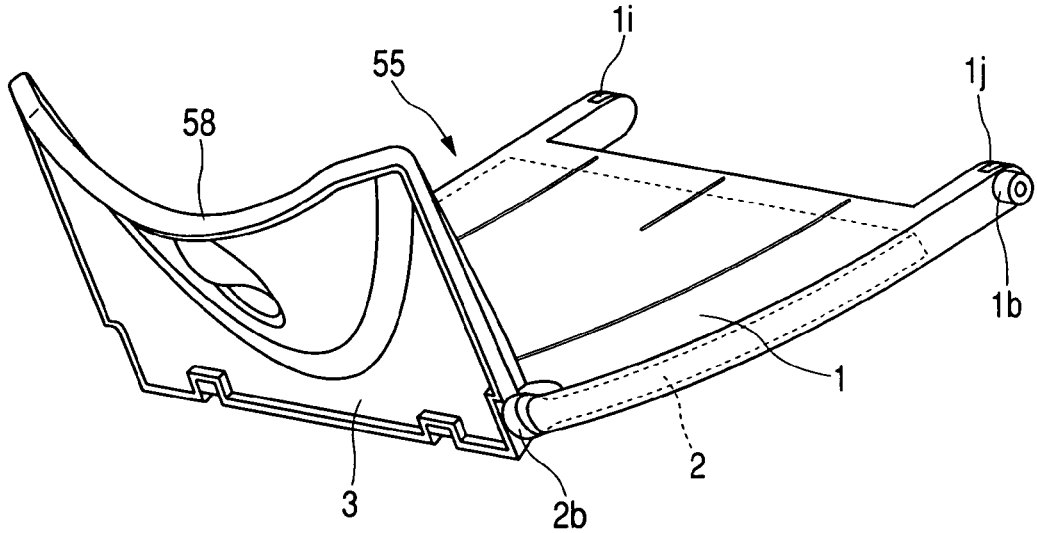
FIG. 15 is a schematic perspective view of the sheet discharge tray unit of the recording apparatus according to the first embodiment of the invention.

FIG. 10 is the schematic perspective view showing the first sheet discharge tray of the recording apparatus according to the first embodiment of the invention when viewed from the backside, FIG. 11 is the schematic perspective view showing the first sheet discharge tray of FIG. 10 when viewed from the surface side, FIG. 12 is the schematic perspective view showing the second sheet discharge tray of the recording apparatus according to the first embodiment of the invention when viewed from the surface side, FIG. 13 is the schematic perspective view showing the second sheet discharge tray of FIG. 12 when viewed from the surface side, FIG. 14 is the schematic perspective view showing the third sheet discharge tray of the recording apparatus according to the first embodiment of the invention when viewed from the surface side, FIG. 15 is the schematic perspective view of the sheet discharge tray unit of the recording apparatus according to the first embodiment of the invention.

In FIGS. 10 to 15, rail portions 1*g* and 1*h* overhanging toward the inside are formed on left and right side portions of the first sheet discharge tray 1. The second sheet discharge tray 2 can be drawn from and retracted into the first sheet discharge tray 1 by guiding and sliding the left and right end peripheral portions of the second sheet discharge tray 2 along the inside faces of the rail portions 1*g* and 1*h*. Fitting portions 1*k* and 1*l* are formed in the front portion (front side) of the rail portions 1*g* and 1*h* while being able to engage protrusions 2*e* and 2*f* of the second sheet discharge tray 2. Therefore, when the operator strongly draws the second sheet discharge tray 2, the amount of movement of the second sheet discharge tray 2 is controlled so that the second sheet discharge tray 2 does not fly out (disengage) from the first sheet discharge tray 1. Pawls 1*c*, 1*d*, 1*e*, and 1*f* are formed on the backside of the first sheet discharge tray 1. The pawls 1*c*, 1*d*, 1*e*, and 1*f* are arranged so as to retain and fix the second sheet discharge tray 2 in position by engaging the protrusions 2*c* and 2*d* of the second sheet discharge tray 2.

The sheet loading surface of the first sheet discharge tray 1 is formed by a broad plane having a curvature so as to be deformed by a proper load. This enables an appropriate click to be obtained in drawing and retracting the second sheet discharge tray 2. Guide protrusions (slide protrusions) 1*a* and 1*b* are formed on the both sides in a rear portion of the first sheet discharge tray 1. In drawing and retracting the sheet discharge tray unit 55, the guide protrusions 1*a* and 1*b* slide along stepwise grooves 5*b*, 5*i*, 5*j*, 5*e*, 5*c*, and 5*k* (FIG. 7) which are of the guide formed in the tray accommodation unit 5*a* of the lower case 5. Further, the concave portions 1*i* and 1*j* are formed on the side of the sheet loading surface of the guide protrusions 1*a* and 1*b*. The concave portions 1*i* and 1*j* are adapted to engage concave and convex portions (including convex portion 5*d*) formed in the stepwise grooves when the sheet discharge tray unit 55 is accommodated in the tray accommodation unit 5*a*. The concave portions 1*i* and 1*j* eliminate rattle when the sheet discharge tray unit 55 is accommodated.

In FIGS. 12 and 13, bearing portions 2*a* and 2*b* are formed on the both sides of the front portion of the second sheet discharge tray 2 while hanging. Rotating shafts 3*a* and 3*b* formed on the both sides of the rear portion of the third sheet discharge tray 3 are inserted into the bearing portions 2*a* and 2*b* while holding appropriate friction force to the bearing portions 2*a* and 2*b*. Two grooves are formed on the sheet loading surface of the second sheet discharge tray 2, and protrusions 2*c* and 2*d* which can fit to the pawls 1*c* to 1*f* of the first sheet discharge tray 1 are formed in the rear portions of the grooves respectively. The side face of the second sheet discharge tray 2 is shaped so that the second sheet discharge tray 2 is slidably retained forward and backward by inserting the second sheet discharge tray 2 into the overhanging rail portions 1*g* and 1*h*. Protrusions 2*j* and 2*k* are formed on the left and right sides in the front portion of the second sheet discharge tray 2 (FIG. 13).

The protrusions 2*j* and 2*k* constitute angle controlling means for controlling and adjusting the angle in an attitude, in which the sheet loading surface of the third sheet discharge tray 3 is orientated upward, by abutting on the sheet loading surface of the third sheet discharge tray 3. The protrusions 2*j* and 2*k* are initially formed in a low profile, and the fine adjustment is performed by increasing the heights of the protrusions 2*j* and 2*k* when the height of the front end of the third sheet discharge tray 3 does not reach a target value due to influences such as the rattle of the sheet discharge tray, deformation of deadweight, warpage of the component itself, and tolerance of each component. The protrusions 2*j* and 2*k* adjust the angle of the sheet discharge tray. While the angle adjustment protrusions are provided in the second sheet discharge tray 2 in the embodiment, it is also possible to provide the angle adjustment protrusions in the third sheet discharge tray 3. In the working of adjusting the heights of the protrusions 2*j* and 2*k*, a mold is shaved due to a mold structure, so that mold modification is easy to perform. Further, when the protrusions 2*j* and 2*k* are formed in nesting structure, the mold modification can be more simply performed. Protrusions 2*e* and 2*f* engaging the fitting portions 1*k* and 1*l* of the first sheet discharge tray 1 are formed on the both sides in the rear portion of the backside of the second sheet discharge tray 2.

In FIGS. 10 to 15, the front end portion of the third sheet discharge tray 3 is formed in the concave shape, a handgrip portion 3*e* for drawing the sheet discharge tray is formed in a part of the front end portion of the third sheet discharge tray 3. Rotating shafts 3*a* and 3*b* are formed on the both side in the rear portion of the third sheet discharge tray 3. The bearing portions 2*a* and 2*b* and the rotating shafts 3*a* and 3*b* form a rotation center when the third sheet discharge tray 3 is rotated relative to the second sheet discharge tray 2. Ribs 3*c* and 3*d* are formed on the left and right sides of the sheet loading surface (surface) of the third sheet discharge tray 3. The ribs 3*c* and 3*d* prevents sheet-discharge failure by curling the recording sheet to lift the both end of the recording sheet when the recording sheet is discharged to be loaded on the third sheet discharge tray 3. In the third sheet discharge tray 3, regions on which protrusions 2*j* and 2*k* on the left and right sides of the front portion the second sheet discharge tray 2 abut are located in regions 3*f* and 3*g* on the sheet loading surface shown in FIG. 14 or near the regions 3*f* and 3*g*.

In the sheet discharge tray unit 55 shown in FIG. 15, the second sheet discharge tray 2 to which the third sheet discharge tray 3 is rotatably attached is inserted (accommodated) inside the first sheet discharge tray 1. When the front cover 4 is opened from the state, in which the sheet discharge tray unit 55 is accommodated in the tray accommodation unit 5*a*, to pull and rotate the third sheet discharge tray 3, the sheet discharge tray constituted only by sheet loading surface of the third sheet discharge tray 3 is formed, and then the sheet discharge tray constituted by the first sheet discharge tray 1 and the third sheet discharge tray 3 is formed by drawing the first sheet discharge tray 1 while the third sheet discharge tray 3 is accommodated in the first sheet discharge tray 1. Further, the sheet discharge tray constituted by the three sheet loading surfaces of the sheet discharge trays 1, 2, and 3 by drawing the second sheet discharge tray 2 from the first sheet discharge tray 1.

Figure 16:
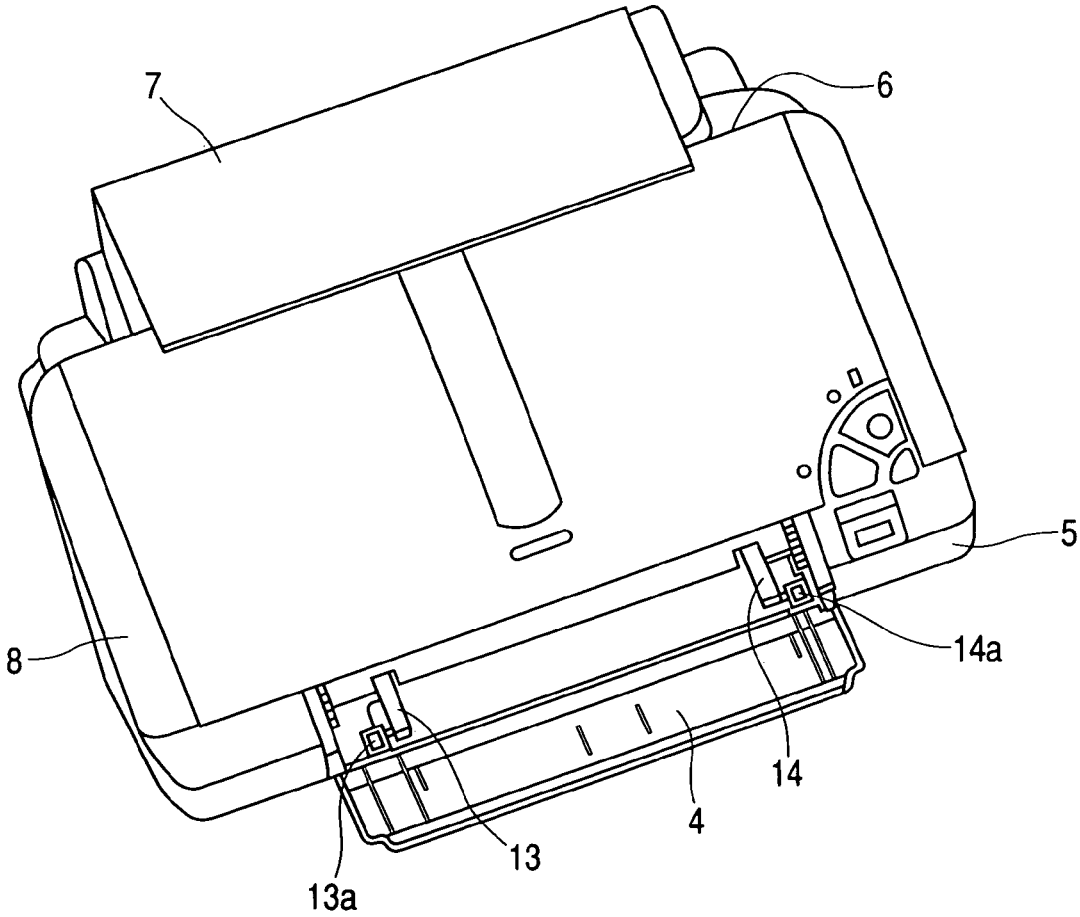
FIG. 16 is a schematic perspective view showing the state in which the cover member is opened in the recording apparatus according to the first embodiment of the invention when viewed from the top side.
Figure 17:
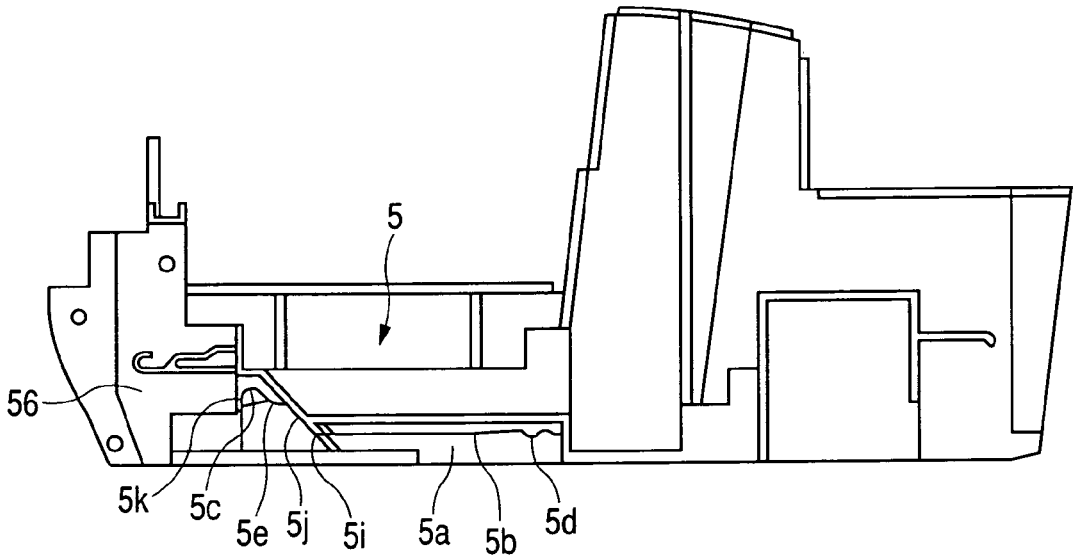
FIG. 17 is a longitudinal sectional view schematically showing an inside of the lower case including the tray accommodation unit of the recording apparatus according to the first embodiment of the invention.
Figure 18:
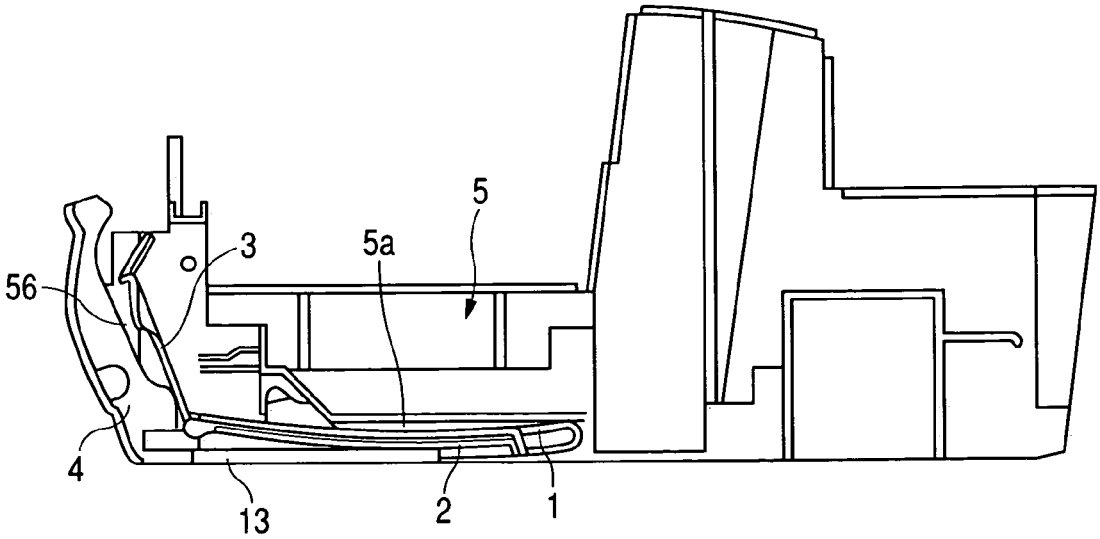
FIG. 18 is a longitudinal sectional view schematically showing the inside state of the lower case when the sheet discharge tray is accommodated in the tray accommodation unit in the recording apparatus according to the first embodiment of the invention.
Figure 19:
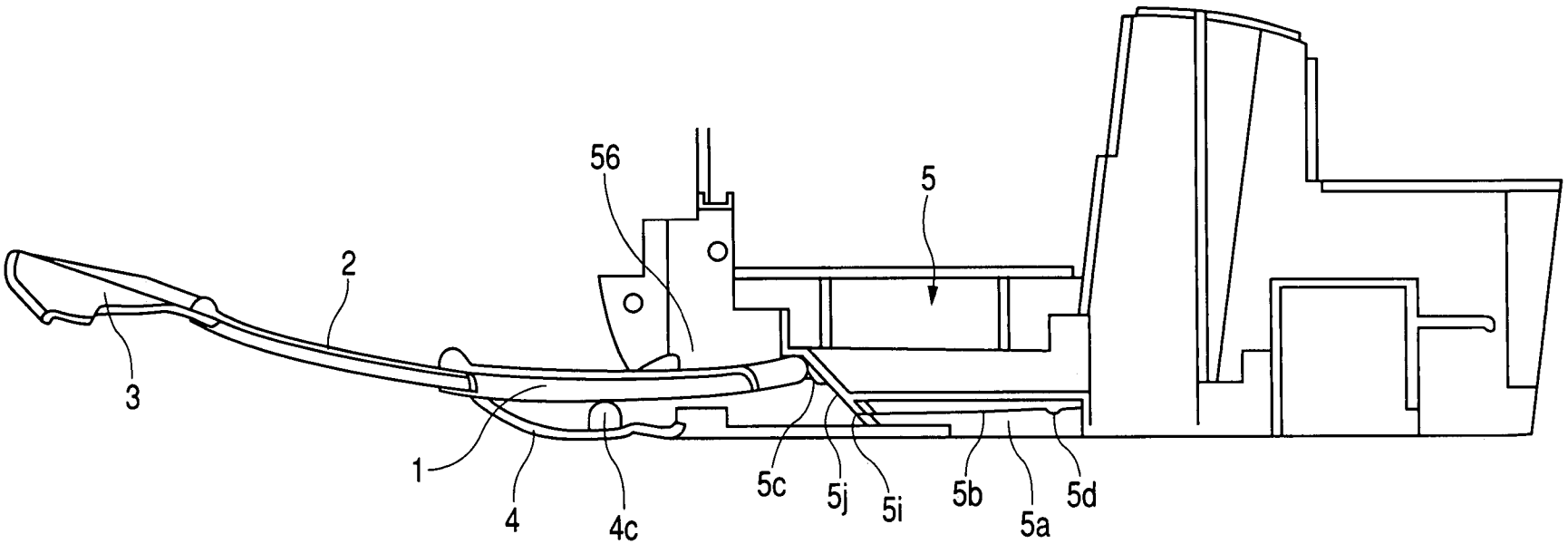
FIG. 19 is a longitudinal sectional view schematically showing the lower case and the state in which the sheet discharge tray is drawn from the tray accommodation unit in the recording apparatus according to the first embodiment of the invention.

FIG. 16 is the schematic perspective view showing the state in which the cover member is opened in the recording apparatus according to the first embodiment of the invention when viewed from the top side, FIG. 17 is a longitudinal sectional view schematically showing the inside of the lower case including the tray accommodation unit of the recording apparatus according to the first embodiment of the invention, FIG. 18 is the longitudinal sectional view schematically showing the inside state of the lower case when the sheet discharge tray is accommodated in the tray accommodation unit in the recording apparatus according to the first embodiment of the invention, and FIG. 19 is the longitudinal sectional view schematically showing the lower case and the state in which the sheet discharge tray is drawn from the tray accommodation unit in the recording apparatus according to the first embodiment of the invention.

In FIG. 16, after the sheet discharge tray unit 55 is accommodated in the tray accommodation unit 5*a* of the lower case 5, the left tray rail 13 and the right tray rail 14 which are of the guiding means are fixed to the both sides of the tray accommodation unit 5*a*, and then the front cover 4 which is of the cover member is rotatably attached. In FIG. 16, the front cover 4 is retained at a predetermined opening angle by a protrusion 13*a* of the left tray rail 13 and protrusion 14*a* of the right tray rail 14. FIG. 17 is the longitudinal sectional view showing the structure of the tray accommodation unit 5*a* in the lower case 5 before the sheet discharge tray unit 55, the left and right tray rails 13 and 14, and the front cover 4 are attached. FIG. 18 shows the state after the sheet discharge tray unit 55 is accommodated in the tray accommodation unit 5*a*, the left and right tray rails 13 and 14 are fixed, and the front cover 4 is attached. FIG. 19 shows the state in which the front cover 4 is opened to draw the sheet discharge tray unit 55 after the state shown in FIG. 18.

When the sheet discharge tray unit 55 is accommodated in the tray accommodation unit 5*a*, the sheet discharge tray unit 55 is retained with no rattle in the tray accommodation unit 5*a* in such a manner that the convex portions (protrusions) 5*d* formed in top faces 5*b* on the both sides of the tray accommodation unit 5*a* engage the concave portions 1*i* and 1*j* of the guide protrusions 1*a* and 1*b* of the first sheet discharge tray 1. The third sheet discharge tray 3 is accommodated inside the closed front cover 4 while vertically standing between the front cover 4 and the opening portion 56, or between the front cover 4 and the later-mentioned discharge roller 42. When the operator performs the recording (printing), the operator puts operator's hand on or places operator's finger on a grip portion 4*e* formed by a wide opening of the front cover 4 to pull and rotate the front cover 4. As the front cover 4 is rotated, the third sheet discharge tray 3 is slowly rotated by the deadweight at the same time, and then the handgrip portion 3*e* of the third sheet discharge tray 3 is exposed as shown in FIG. 4. The handgrip portion 3*e* of the third sheet discharge tray 3 is pulled by placing operator's finger on the handgrip portion 3*e*.

Then, the fitting between the concave portions 1*i* and 1*j* of the first sheet discharge tray 1 and the convex portions of the tray accommodation unit 5*a* is released, and the guide protrusions 1*a* and 1*b* slide toward the left direction of FIGS. 17 to 19 reach a boundary point 5*i* while abutting on the top faces 5*b* on the both sides of the tray accommodation unit 5*a*. When the sheet discharge tray unit 55 is further drawn, the guide protrusions 1*a* and 1*b* on the both sides start to climb slops 5*i* and 5*j* constituting the stepwise grooves of the tray accommodation unit 5*a* and climb over swell portions 5*e* and 5*e* to reach reception portions 5*c* and 5*c*. Since stopper portions (wall portions) 5*k* and 5*k* are formed at a position on the left side of the reception positions 5*c* and 5*c* of FIGS. 17 to 19, the first sheet discharge tray 1 can not be moved toward the left direction any more of FIGS. 17 to 19 when the guide protrusions 1*a* and 1*b* reach the position of the reception portions 5*c* and 5*c*.

In the embodiment, the stepwise grooves having difference of elevation are formed on the both sides of the tray accommodation unit 5*a* in order to slide the guide protrusions 1*a* and 1*b* provided in the sheet discharge tray unit 55 (the first sheet discharge tray 1), and the stepwise groove includes the top face 5*b*, the boundary point 5*i*, the slop 5*j*, the swell portion 5*e*, the reception portion 5*c*, and the wall portion (stopper portion) 5*k*. When the third sheet discharge tray 3 is further pulled, the pawls 1*d* and 1*f* of the first sheet discharge tray 1 disengage the protrusions 2*c* and 2*d* of the second sheet discharge tray 2 to pull the second sheet discharge tray 2. When the third sheet discharge tray 3 is still further pulled, the protrusions 2*c* and 2*d* of the second sheet discharge tray 2 engage the pawls 1*c* and 2*e* formed on the left and right sides of the front portion of the first sheet discharge tray 1, and the second sheet discharge tray 2 can not be finally pulled any more.

When the operator releases operator's finger from the handgrip portion 3*e* of the third sheet discharge tray 3, the sheet discharge tray unit 55 comes down by the deadweight of the third sheet discharge tray 3 and the second sheet discharge tray 2 while the sheet discharge tray unit 55 is rotated about the guide protrusions 1*a* and 1*b*. The bottom surface of the first sheet discharge tray 1 abuts on the top faces of height adjustment ribs 4*c* and 4*d* of the retaining convex portion formed in the front cover 4 and the sheet discharge tray unit is retained at a predetermined angle. The left tray rail 13 and the right tray rail 18 are attached to the lower case 5 and the bottom surface of the first sheet discharge tray 1 is guided and retained by the slide portions 13*b* of the left tray rail 13 and the slide portions 14*b* of the right tray rail 14, so that the sheet discharge tray unit 55 never drops off from the tray accommodation unit 5*a* in the procedure of drawing the sheet discharge tray unit 55.

As can be seen from the above descriptions, since the tray accommodation unit 5*a* and the sheet discharge tray unit 55 have the substantially symmetric shape, the movements are the same on the left and right sides. As described in FIG. 17, in the structure of the embodiment, the stepwise grooves having the difference of elevation are formed on the both sides of the tray accommodation unit 5*a*, and the left and right guide protrusions 1*a* and 1*b* provided in the sheet discharge tray unit 55 slide in the stepwise grooves. In the structure of FIGS. 16 to 19, the stepwise groove is formed by the top face 5*b*, the boundary point 5*i*, the slop 5*j*, the swell portion 5*e*, the reception portion 5*c*, and the wall portion (stopper portion) 5*k*. The sheet discharge mechanism which has operability of drawing and retracting the sheet discharge tray and also has the advantage for miniaturization of the recording apparatus and improvement of performance of the recording apparatus can be obtained by sliding the guide protrusions 1*a* and 1*b* of the first sheet discharge tray 1 in the stepwise grooves having the difference of elevation.

Further, the left and right guide protrusions 1*a* and 1*b* engage the reception portions 5*c* and 5*c* located at the highest positions of the guide grooves when the sheet discharge tray unit 55 is drawn, and the guide protrusions 1*a* and 1*b* are supported by the height adjustment ribs 4*c* and 4*d*, so that the recording medium loading surface is located at the position near the opening portion or the later-mentioned discharge roller 42 even if the recording medium loading surface is accommodated in the tray accommodation unit 5*a*.

Since the grip portion 4*e* having the wide opening is formed in the front cover 4 which is of the cover member, even if the operator performs recording start operation by mistake while the front cover 4 is closed, disadvantage such as sheet jam can be avoided because the recording sheet is discharged through the grip portion 4*e*. The top portions of the height adjustment ribs 4*c* and 4*d* of the front cover 4 are formed in the arcuate shape, and the height adjustment ribs 4*c* and 4*d* slide the bottom portion of the first sheet discharge tray 1 when the front cover 4 is closed, so that the first sheet discharge tray 1 can be moved toward the accommodation direction in conjunction with the closing operation of the front cover 4 and the front cover is fully closed, even if the first sheet discharge tray 1 is flies out from the tray accommodation unit 5*a*.

Further, since ribs 4*f* and 4*g* (FIG. 9) are formed on the backside of the front cover 4, when the front cover 4 is opened, the front portion of the backside of the third sheet discharge tray 3 abuts on the ribs 4*f* and 4*g* to retain the third sheet discharge tray 3 while the third sheet discharge tray 3 is raised from the front cover 4. Accordingly, the operator can easily place operator's finger on the handgrip portion 3*e* of the third sheet discharge tray 3 by securing an appropriate gap (clearance) between the front cover 4 and the third sheet discharge tray 3, and the improvement of the operability of can be performed.

Figure 20:
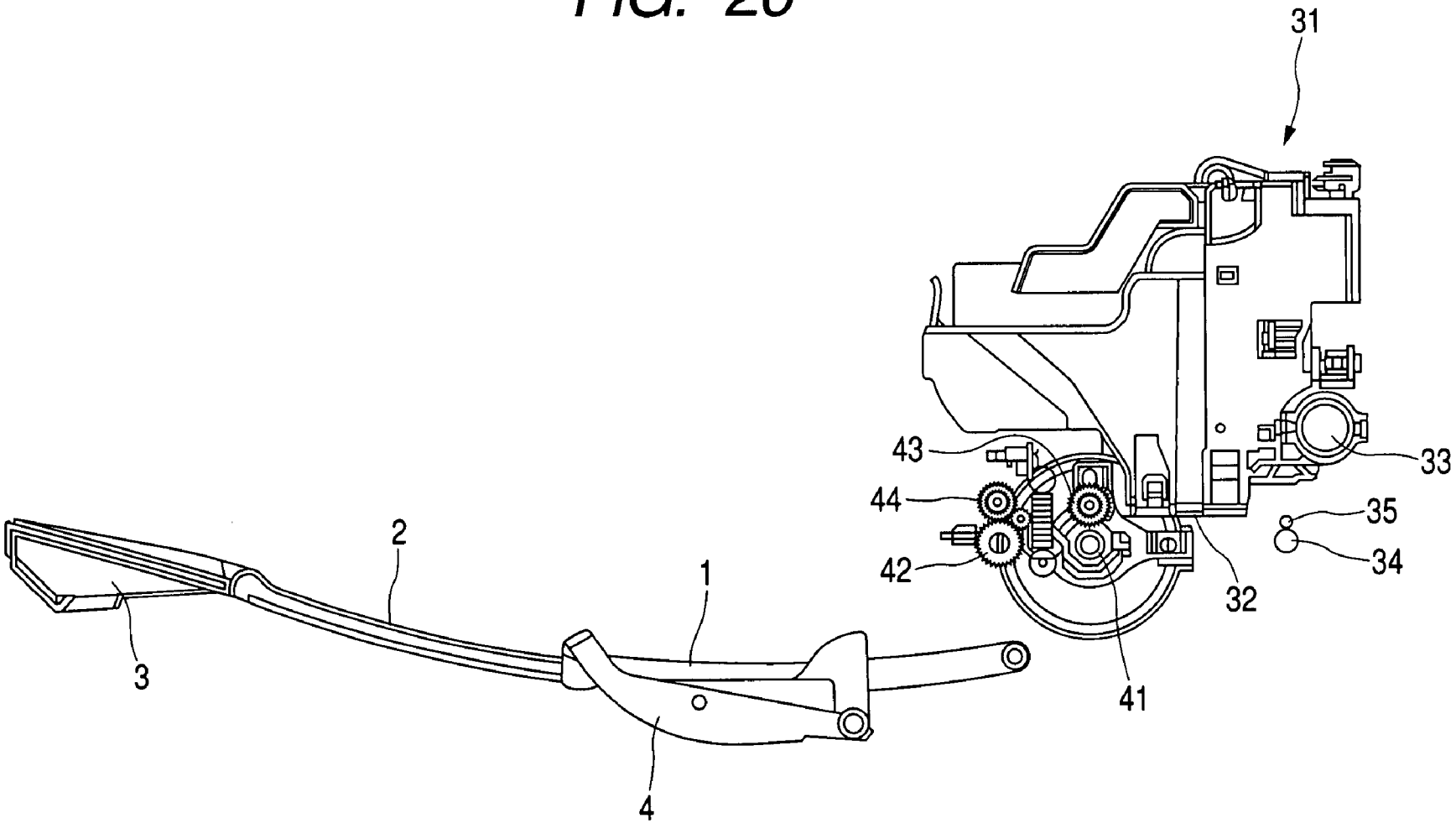
FIG. 20 is a sectional view showing a recording unit of the recording apparatus to which the invention is applied.

FIG. 20 shows the recording unit of the recording apparatus. In FIG. 20, the reference numeral 32 designates a recording head constituting recording means. As described above, the recording head 32 ejects the ink by the thermal energy. The recording head 32 is mounted on a carriage 31. The carriage 31 ejects the ink to perform the recording while guided by a carriage guide 33 to be moved in the direction orthogonal to the conveying direction of the recording medium.

The reference numeral 34 designates a conveying roller which is of conveying means for conveying the recording medium, and the conveying roller 34 is arranged on the upstream side of the recording head 32. The reference numeral 35 designates a pinch roller which presses the recording medium against the conveying roller 34. The reference numerals 41 and 42 designate a first discharge roller and a second discharge roller, which constitute discharging means for discharging the recording medium to the outside. The first discharge roller 41 is arranged on the downstream side of the recording head 32 and the second discharge roller 42 is arranged on the downstream side of the first discharge roller 41. The reference numeral 43 designates a first star gear roller which presses the recording medium against the first discharge roller 41. The reference numeral 44 designates a second star gear roller which presses the recording medium against the second discharge roller 42.

As described above, in accordance with the embodiment described in FIGS. 1 to 20, the stepwise grooves in which the guide protrusions 1*a* and 1*b* provided on the both sides of the rear portion of the first sheet discharge tray 1 slide in drawing and retracting the sheet discharge tray unit 55 are provided in the tray accommodation unit 5*a* of the lower case, and the third sheet discharge tray 3 is rotatably attached about the front portion of the second sheet discharge tray 2. Therefore, the recording apparatus, which has the excellent operability of drawing and retracting the sheet discharge tray and excellent design in accommodating the sheet discharge tray and includes the sheet discharge mechanism having the advantage for the miniaturization and the improvement of the performance of the recording apparatus, can be formed.

Figure 21:
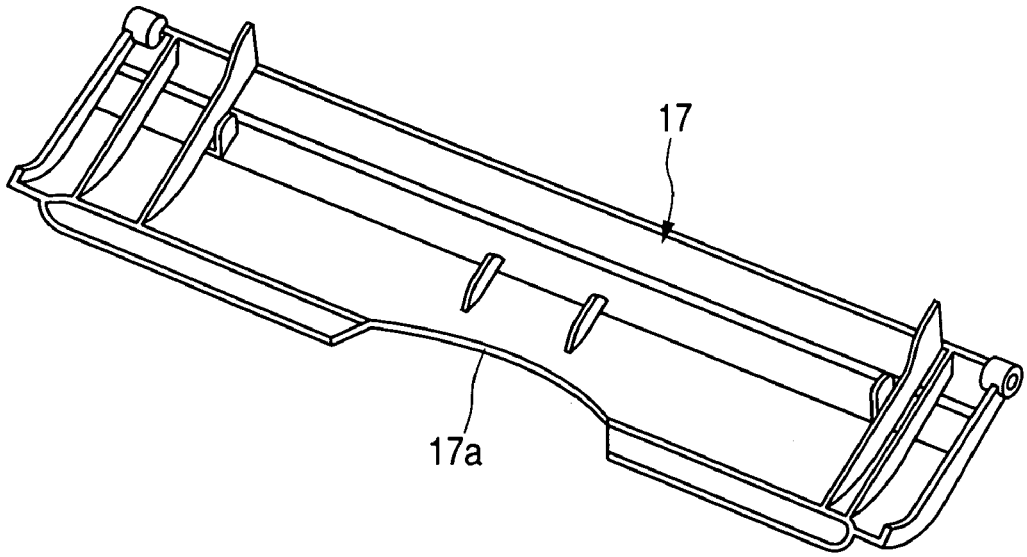
FIG. 21 is a schematic perspective view showing the cover member (front cover) of the recording apparatus according to a second embodiment of the invention.
Figure 22:
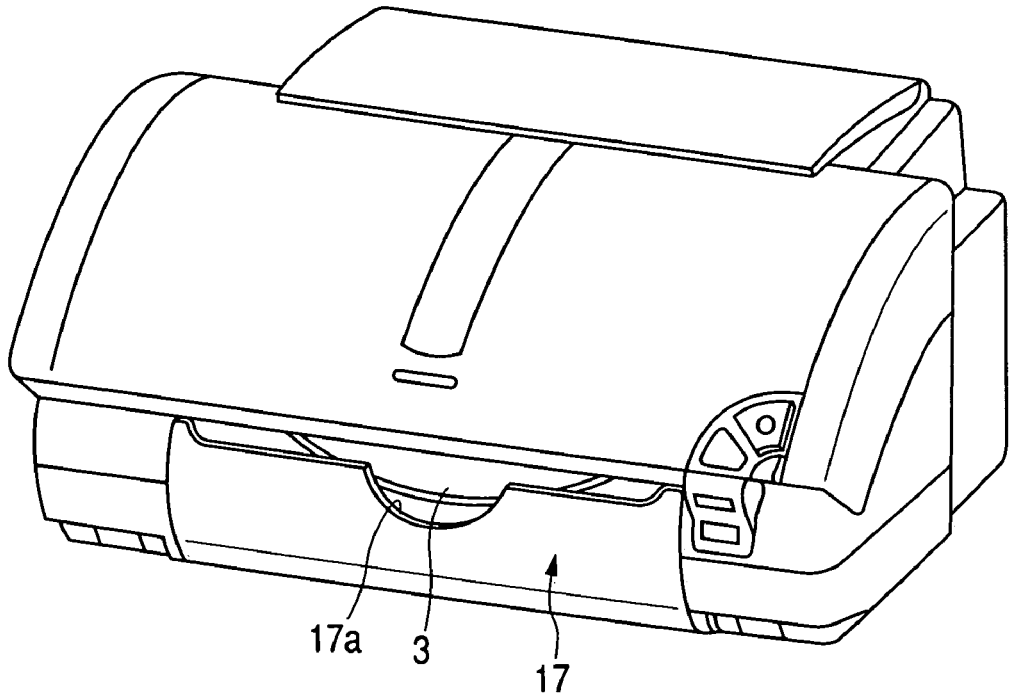
FIG. 22 is a schematic perspective view showing the state in which the cover member is closed in the recording apparatus according to the second embodiment of the invention.
Figure 23:
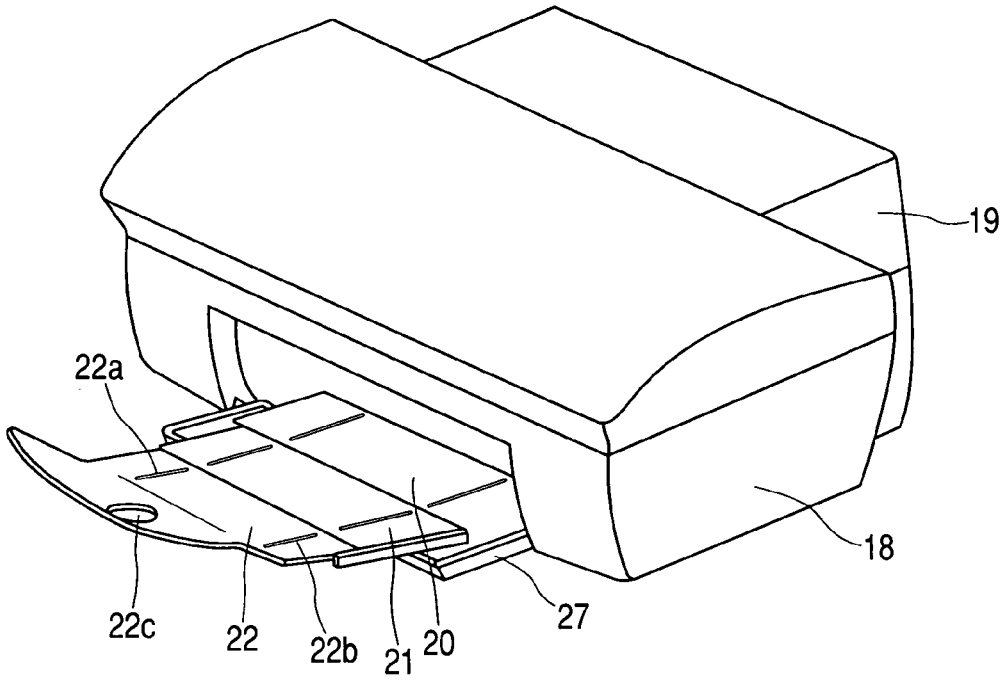
FIG. 23 is a schematic perspective view showing the state in which the sheet discharge tray is drawn in the conventional recording apparatus.
Figure 24:
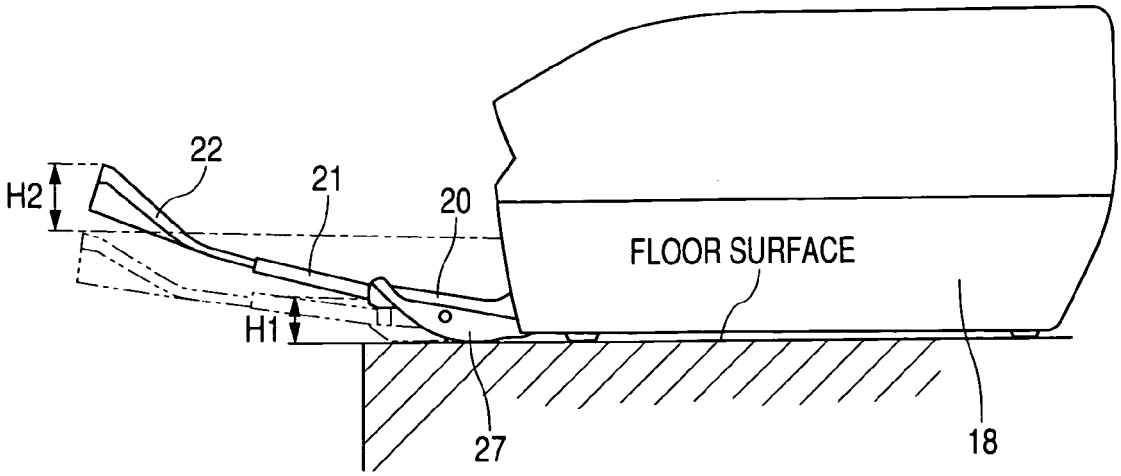
FIG. 24 is a schematic side elevation for explaining a technical problem of the sheet discharge tray in the conventional recording apparatus.
Figure 25:
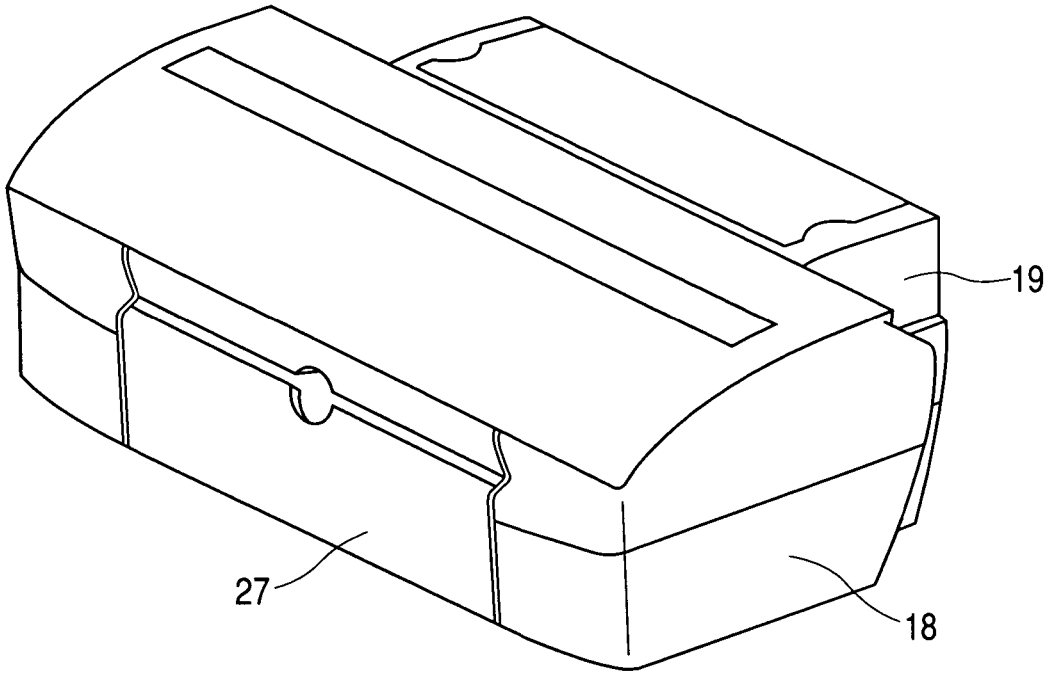
FIG. 25 is a schematic perspective view showing the state in which the front cover is closed in the conventional recording apparatus.
Figure 26:
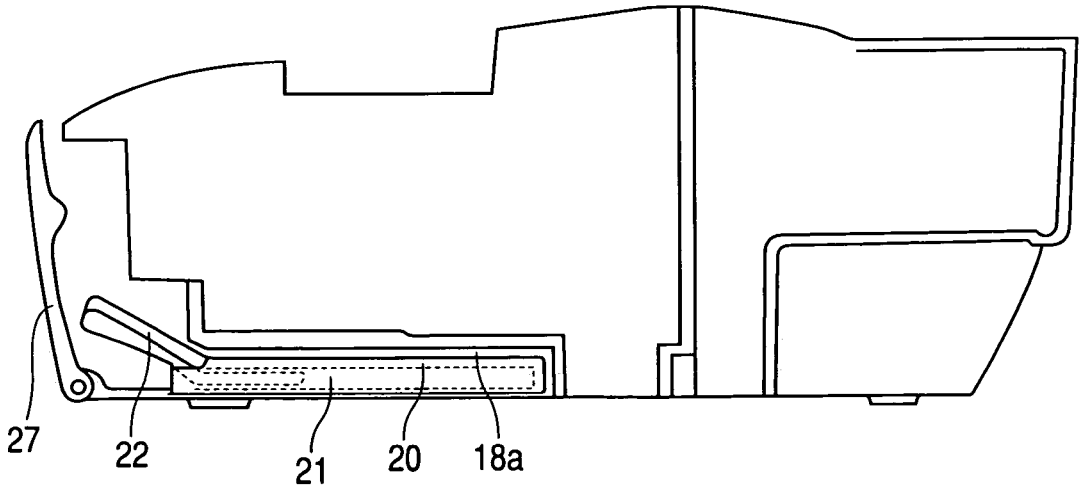
FIG. 26 is a schematic longitudinal sectional view mainly showing a structure of the tray accommodation unit of the lower case in the conventional recording apparatus.

FIG. 21 is the schematic perspective view showing the cover member (front cover) of the recording apparatus according to a second embodiment of the invention, and FIG. 22 is the schematic perspective view showing the state in which the cover member is closed in the recording apparatus according to the second embodiment of the invention. In FIGS. 21 and 22, a front cover 17 which is of the cover member for opening and closing the opening portion 56 is rotatably attached to the opening portion 56 formed in the front portion of the exterior of the recording apparatus. A cutout 17*a* is formed in the front portion of the front cover 17. The operator can access the handgrip portion 3*e* of the third sheet discharge tray 3 through the cutout 17*a* even if the front cover 17 is closed. However, the second embodiment shown in FIGS. 21 and 22 differs from the first embodiment shown in FIGS. 1 to 19 in the structure of the front cover, the second embodiments has the substantially the same configuration as the first embodiment in other points.

In the first embodiment shown in FIGS. 1 to 19, when the operator performs the recording, the operator first rotates the front cover 4, which allows the third sheet discharge tray 3 to be slowly rotated in the forward direction in conjunction with the rotation of the front cover 4 to expose the handgrip portion 3*e* in front of the recording apparatus. Then, the operator places operator's finger on the handgrip portion 3*e* to performs the operation of pulling the sheet discharge tray. Namely, in the first embodiment shown in FIGS. 1 to 19, since the operator changes the positions of operator's finger from the front cover 4 to the handgrip portion 3*e* in order to draw the sheet discharge tray unit 55, the operator performs the operation of drawing the sheet discharge tray by two actions.

On the other hand, in the second embodiment shown in FIGS. 21 and 22, the handgrip portion 3*e* is always exposed by providing the minimum cutout 17*a* of an extent that the operator's finger can enter the cutout 17*a* in the front portion of the front cover 17. In performing the recording, since the operator can directly place operator's finger on the handgrip portion 3*e* of the third sheet discharge tray 3, the operator places operator's finger on the handgrip portion 3*e* to rotate the third sheet discharge tray 3 in the forward direction, which allows the front cover 17 to be simultaneously rotated in the forward direction. Namely, in accordance with the second embodiment, when the recording is started, the sheet discharge tray unit 55 can be drawn without changing positions of the finger only by one action in which the operator places operator's finger on the handgrip portion 3*e* to rotate the third sheet discharge tray 3 in the forward direction. Therefore, in accordance with the configuration of the second embodiment, in addition to the same effect as the first embodiment, the operator can draw the sheet discharge tray without changing positions of the finger by one action, and the further improvement of the operability is achieved when compared with the first embodiment.

The embodiments described above include the exterior of the apparatus having the opening portion 56 for discharging the recording medium in which the recording has been performed, the sheet discharge tray unit 55 having the plurality of sheet discharge trays 1, 2, and 3 for stacking and retaining the recording medium discharged from the opening portion, the cover member 4 or 17 which is rotatably attached to the exterior of the apparatus in order to open and close the opening portion, the tray accommodation unit 5*a* which is provided in the bottom portion of the exterior of the apparatus in order to drawably accommodate the sheet discharge tray unit 55, and the guiding means 13 and 14 for retaining the cover member in predetermined position while guiding the sheet discharge trays in the drawing direction and in the accommodating direction, wherein the sheet discharge tray drawn from the tray accommodation unit is retained at the predetermined opening position on the backside of the cover member, and the stepwise grooves 5*b*, 5*i*, 5*j*, 5*e*, 5*c*, and 5*k* having the difference of elevation for sliding the guide protrusions 1*a* and 1*b* provided in the sheet discharge tray unit are formed on the both sides of the tray accommodation unit. The recording apparatus, which has the excellent operability of drawing and retracting the sheet discharge trays 1, 2, 3 and the excellent design in accommodating the sheet discharge tray and includes the sheet discharge mechanism having the advantage for the miniaturization and the improvement of the performance of the recording apparatus, is provided in accordance with the above-described configuration.

In the embodiments, the sheet discharge tray unit 55 adopts the configuration having the first sheet discharge tray 1 which is slidably connected in the drawing and retracting direction relative to the tray accommodation unit 5*a*, the second sheet discharge tray 2 which is slidably connected in the drawing and retracting direction relative to the first sheet discharge tray 1, and the third sheet discharge tray 3 which is slidably connected in the drawing and retracting direction relative to the second sheet discharge tray 2. Further, the embodiments adopt the configuration in which the guide protrusions 1*a* and 1*b* are formed on the both sides in the rear portion of the first sheet discharge tray 1, the protrusions 2*c* and 2*d* engaging the pawls 1*c* and 1*e* of the first sheet discharge tray 1 are formed in the rear portion of the second sheet discharge tray 2, and the bearing portions 2*a* and 2*b* into which the rotating shafts 3*a* and 3*b* of the third sheet discharge tray 3 are inserted are provided on the both sides in the front portion of the second sheet discharge tray 2. Further, in the embodiments, the rotating shafts 3*a* and 3*b* which are inserted into the bearing portions 2*a* and 2*b* are provided on the both sides in the rear portion of the third sheet discharge tray 3, and the arcuate curved surface 58 is formed in the front portion of the third sheet discharge tray 3.

In the embodiments, the protrusions 2*j* and 2*k* for adjusting the angle of the sheet discharge tray are formed in the second sheet discharge tray 2 or the third sheet discharge tray 3. The height adjustment ribs 4*c* and 4*d* for adjusting the height of the sheet discharge tray unit are provided on the surface side where the cover member 4 or 17 abuts on the sheet discharge tray unit 55, and the third sheet discharge tray 3 is rotated relative to the second sheet discharge tray 2 in conjunction with the opening and closing of the cover member 4 or 17. The exterior of the apparatus is formed by combining the lower case 5 and the upper case 6. The grip portion 4*e* for opening and closing operations is formed in the front portion of the cover member 4 in the first embodiment. On the other hand, instead of the grip portion 4*e*, the cutout 17*a* having the size into which the operator can insert operator's finger is formed in the front portion of the cover member 17 in the second embodiment, which allows the sheet discharge tray to be drawn by one action.

Although the case in which the recording apparatus is the inkjet recording apparatus was cited as an example in the above-described embodiments, the invention can be also applied to the recording apparatus adopting other recording methods such as a wire-dot matrix printing recording apparatus, a thermal recording apparatus, a laser-beam recording apparatus, or an electrophotographic recording apparatus, and the invention can be also achieve the same effect in the other recording methods. Although the inner configuration such as the type of recording head or the number of recording heads were not specifically described in the embodiments, the invention can be applied independently of the type of recording head or the number of recording heads and can achieve the above-described effect, such that the invention can be applied to the recording apparatus using one recording head, the color inkjet recording apparatus using the plurality of recording heads to perform the recording in different colors, the inkjet recording apparatus for gradation recording in which the recording is performed by the ink having the different density in the same color, or the like.

The invention can be applied to both the serial type recording apparatus in which the recording is performed by moving the recording head of the recording means in the main scanning direction and the line type recording apparatus in which the recording is performed only by the sub-scanning using the line type recording head covering a full width or a part of the recording medium, and the invention can achieve the same effect. The invention can be applied independently of the configurations of the recording means (recording head) and the ink tank and achieve the same effect, such that invention can be applied to the cartridge type recording means in which the recording head and the ink tank are integrated, the recording means having the configuration in which the recording head and the ink tank are separated from each other and connected with an ink supply tube, or the like.

In the case where the invention is applied to the inkjet recording apparatus, the invention can be also applied to the recording apparatus using the recording means in which the electromechanical transducer such as the piezoelectric element is utilized, and in particular the invention realizes the excellent effect in the inkjet recording apparatus using the recording means in which the thermal energy is utilized to eject the ink. This is because the high-density recording and high resolution can be achieved in the inkjet recording apparatus utilizing the thermal energy.

As can be seen from the above descriptions, in accordance with the invention, the recording apparatus, which has the excellent operability of drawing and retracting the sheet discharge tray and the excellent design in accommodating the sheet discharge tray and includes the sheet discharge mechanism having the advantage for the miniaturization and the improvement of the performance of the recording apparatus, is provided.

This application claims priority from Japanese Patent Application No. 2003-205479 filed Aug. 1, 2003, which is hereby incorporated by reference herein.

What is claimed is:

1. A recording apparatus comprising:

an opening portion in an exterior of the apparatus for discharging a recording medium on which recording has been performed;

a sheet discharge tray unit having a plurality of sheet discharge trays for stacking the recording medium discharged from the opening portion;

a cover member which is rotatably attached to the exterior of the apparatus in order to open and close the opening portion;

a tray accommodation portion which is provided in a bottom portion of the exterior of the apparatus in order to drawably accommodate the sheet discharge tray unit; and a tray rail for guiding the movement of said sheet discharge tray unit, wherein a sheet discharge tray drawn from the tray accommodation portion is retained at a predetermined opening portion on a backside of the cover member.

2. A recording apparatus according to claim 1, wherein the sheet discharge tray unit has a first sheet discharge tray which is slidably connected in a drawing and retracting direction relative to the tray accommodation portion, a second sheet discharge tray which is slidably connected in the drawing and retracting direction relative to the first sheet discharge tray, and a third sheet discharge tray which is rotatably connected to the second sheet discharge tray.

3. A recording apparatus according to claim 2, wherein guide protrusions are formed on both sides of a rear portion of the first sheet discharge tray.

4. A recording apparatus according to claims 2, wherein protrusions engaging pawls for the first sheet discharge tray are formed on a rear portion of the second sheet discharge tray, and bearing portions into which rotating shafts of the third sheet discharge tray are provided on both sides in a front portion of the second sheet discharge tray.

5. A recording apparatus according to claim 4, wherein the rotating shafts which are inserted into the bearing portions of the second sheet discharge tray are provided on both sides in a rear portion of the third sheet discharge tray, and an arcuate curved surface is formed in a front portion of the third sheet discharge tray.

6. A recording apparatus according to claim 2, wherein protrusions for adjusting an angle of a sheet discharge tray are formed in the second sheet discharge tray or the third sheet discharge tray.

7. A recording apparatus according to claim 2, wherein the third sheet discharge tray is rotated relative to the second sheet discharge tray in conjunction with opening and closing the cover member.

8. A recording apparatus according to claim 1, wherein a handgrip portion for opening and closing operations is formed in a front portion of the cover member.

9. A recording apparatus according to claim 1, wherein height adjustment ribs for adjusting a height of the sheet discharge tray unit are provided on a surface side where the cover member abuts on the sheet discharge tray unit.

10. A recording apparatus according to claim 1, wherein a cutout having a size into which an operator can insert the operator's finger is formed in a front portion of the cover member.

11. A recording apparatus according to claim 1, wherein the exterior of the apparatus comprises a lower case and an upper case.

* * * * *

UNITED STATES PATENT AND TRADEMARK OFFICE

CERTIFICATE OF CORRECTION

PATENT NO. : 7,290,952 B2
APPLICATION NO. : 10/902058
DATED : November 6, 2007
INVENTOR(S) : Kagami It is certified that error appears in the above-identified patent and that said Letters Patent is hereby corrected as shown below:

COLUMN 1:
Line 63, “sides” should read --sides of--.

COLUMN 3:
Line 32, “compared” should read --compared to--.
Line 50, “an” should read --a--.

COLUMN 6:
Line 1, “a” should read --an--.
Line 27, “upper cases 6” should read --upper case 6--.
Line 31, “each other.” should read --with each other.--.
Line 46, “Then,” should read --Next--.

COLUMN 10:
Line 33, “side” should read --sides--.
Line 41, “end” should read --ends--.

COLUMN 12:
Line 20, “can” should read --can- --.
Line 20, “can” should read --can- --.
Line 21, “any more.” should read --anymore.--.

COLUMN 13:
Line 14, “is” should be deleted.

COLUMN 15:
Line 67, “can be also” should read --can also--.

COLUMN 16:
Line 3, “were” should read --was--.
Line 24, “invention” should read --the invention--.

UNITED STATES PATENT AND TRADEMARK OFFICE

CERTIFICATE OF CORRECTION

PATENT NO. : 7,290,952 B2
APPLICATION NO. : 10/902058
DATED : November 6, 2007
INVENTOR(S) : Kagami It is certified that error appears in the above-identified patent and that said Letters Patent is hereby corrected as shown below:

COLUMN 17:
Line 15, "claims 2," should read --claims 2,--.

Signed and Sealed this

First Day of July, 2008

JON W. DUDAS
*Director of the United States Patent and Trademark Office*